US007552879B2

(12) United States Patent
Nagata et al.

(10) Patent No.: US 7,552,879 B2
(45) Date of Patent: Jun. 30, 2009

(54) WATER SPOUTING DEVICE

(75) Inventors: Masaaki Nagata, Aichi (JP); Masaki Nishimura, Aichi (JP); Atsushi Kushimoto, Aichi (JP)

(73) Assignee: Inax Corporation, Tokoname-Shi, Aichi (JP)

( * ) Notice: Subject to any disclaimer, the term of this patent is extended or adjusted under 35 U.S.C. 154(b) by 77 days.

(21) Appl. No.: 11/387,071

(22) Filed: Mar. 23, 2006

(65) Prior Publication Data

US 2006/0192032 A1 Aug. 31, 2006

Related U.S. Application Data

(63) Continuation of application No. PCT/JP2004/012120, filed on Aug. 24, 2004.

(30) Foreign Application Priority Data

Sep. 25, 2003 (JP) ..... 2003-334413

(51) Int. Cl.
*B05B 1/32* (2006.01)

(52) U.S. Cl. ..... 239/428.5; 239/438; 239/443; 239/539

(58) Field of Classification Search ..... 239/538, 239/539, 541, 579, 428.5, 435, 437–441, 239/456–460, 443–449, 447
See application file for complete search history.

(56) References Cited

U.S. PATENT DOCUMENTS 2,949,242 A * 8/1960 Blumberg et al. ..... 239/460
3,403,860 A * 10/1968 Shames et al. ..... 239/460
4,657,185 A * 4/1987 Rundzaitis ..... 239/438

FOREIGN PATENT DOCUMENTS

JP S55-35499 8/1980
JP 2001-11916 1/2001

* cited by examiner

*Primary Examiner*—Christopher S Kim
(74) *Attorney, Agent, or Firm*—Manabu Kanesaka

(57) ABSTRACT

A water spouting device 28 capable of being small sized and provided with a good appearance, and further, capable of realizing a comfortable shower spouting and a straight water spouting is provided with a group of numbers of water sprinkling holes 62 formed of small holes being disposed in a manner so as to be dispersed, and a water spouting outlet 74 for the straight water spouting disposed along a peripheral direction in a manner so as to surround an outer peripheral side of the water sprinkling holes 62, which is continuously extending in a peripheral direction. The shower spouting is performed by means of the water spouting from the water sprinkling holes 62, and the straight water spouting with a single line-like regulated water flux is performed by means of both the spouting water from the water sprinkling holes 62 and that from the water spouting outlet 74.

6 Claims, 22 Drawing Sheets

WATER SPOUTING DEVICE

CROSS REFERENCE TO RELATED APPLICATION

This is a continuation application of PCT/JP2004/12120 filed on Aug. 24, 2004.

FIELD OF THE INVENTION

The present invention relates to a water spouting device in a water faucet facilities, and more particularly to a water spouting device having a switching mechanism to switch either a shower spouting or a straight water spouting.

BACKGROUND OF THE INVENTION

Hitherto, a water spouting device in a water faucet facilities is configured to be capable of switching a shower spouting and a straight water spouting formed of a single line-like regulated water flux, in general.

For this purpose, a conventional water spouting device is configured such that a shower spouting outlet and a straight water spouting outlet are respectively disposed at a separate position. For details, the conventional water spouting device is configured such that the straight water spouting outlet is located at a center part, and the shower spouting outlet is located at an outer periphery side in a manner so as to surround the straight water spouting outlet, and in addition, the shower spouting from the shower spouting outlet and the straight water spouting from the straight water spouting outlet are switched by means of a switching mechanism.

The switching mechanism in this case is the one such as that either one of a water spouting path for the shower spouting outlet and that for the straight water spouting outlet is closed and the other water spouting path is opened, and vice versa.

FIGS. 17, 18A and 18B illustrate a water spouting device described in Japanese Unexamined Patent Application Publication No. 2001-11916 provided with such a switching mechanism.

In FIG. 17, the numeral 200 denotes a water spouting device attached to a water spouting head 202 of a water faucet facility, the numeral 204 denotes a straight water spouting outlet provided at a center part of a water sprinkling member 206, and the numeral 208 denotes a shower spouting outlet including a plurality of water sprinkling holes 208*a* formed of a small hole, provided at an outer periphery side from the straight water spouting outlet 204 in a manner so as to surround the straight water spouting outlet 204.

The numerals, 210 and 212, are water spouting paths for the straight water spouting outlet 204 and the shower spouting outlet 208, respectively, and are independently formed to each other. Further, the numerals, 214 and 216, (Refer to FIGS. 18A and 18B) are continuous openings which are respectively allowed to communicate with those water spouting paths, 210 and 212.

Those continuous openings, 214 and 216, are configured in a manner so as to penetrate a valve plate 218.

The numeral 220 is a valve member that switches the water spouting path, 210 and 212, and is connected to a seesaw-type switch-operating portion 226 in an actuation manner via an arm 222 and a shaft 224.

When a left end portion of the switch-operating portion 226, looking from the front (right side in FIG. 17), is pressingly operated, the valve member 220 is integrally rotated with the shaft 224 and the arm 222, and the valve member 220 closes the continuous opening 214 of one side and opens the continuous opening 216 of the other side, as illustrated in FIG. 18A. In other words, the water spouting path 210 that reaches the straight water spouting outlet 204 is closed, and the water spouting path 212 that reaches the shower spouting outlet 208 is brought to an open state.

At this moment, a water supply is introduced to the shower spouting outlet 208 and is spouted outward.

On the other hand, when a right end portion of the switch operating portion 226 is pressingly operated this time, the valve body 220 opens the continuous opening 214 of the one side and closes the continuous opening 216 of the other side, as illustrated in FIG. 18B. Namely, the water spouting path 210 that reaches the straight water spouting outlet 204 is opened and the water spouting path 212 that reaches the shower spouting outlet 208 is brought to a state to be closed.

At this moment, the water supply is introduced by means of the straight water spouting outlet 204 and spouted outward as a regulated water flux in the single line-like manner.

However, in a case of the water spouting device 200, since the straight water spouting outlet 204 and the shower spouting outlet 208 are separately provided, a water spouting area (water spouting space) occupied by each of the straight water spouting outlet 204 and the shower spouting outlet 208 becomes narrower. In addition, along with this situation, the number of the holes of the water sprinkling holes 208*a* is limited or a bore diameter of the straight water spouting outlet 204 is narrowly limited.

Further, the switching mechanism for switching the shower spouting and the straight water spouting becomes complicated, and along with this situation, an entire structure of the water spouting device 200 becomes inevitably large sized. As a result, there have been problems such as that disfigurement of the water spouting device 200 is caused or flexibility of designing is limited.

SUMMARY OF THE INVENTION

An object of the present invention is to provide a water spouting device for use in a water faucet facilities, capable of being small sized and provided with a good appearance, and further, capable of realizing a comfortable shower spouting and a straight water spouting.

The water spouting device of the present invention is provided with a group of water sprinkling holes composed of a plurality of water sprinkling holes for shower spouting and a water spouting outlet for straight water spouting. This water spouting outlet for the straight water spouting is surrounding a periphery of the group of water sprinkling holes. This water spouting device is provided with a water flow-path switching mechanism for performing a first flow-path selection in which the water is only supplied to the group of water sprinkling holes so that the shower spouting is performed, and a second flow-path selection in which the water is supplied to both the group of water sprinkling holes and the water spouting outlet so that the straight water spouting is performed.

When the water spouting from the group of water sprinkling holes is performed together with the water spouting from the water spouting outlet that surrounds the periphery of the group of water sprinkling holes, an inside of a cylindrically shaped water spouting from the water spouting outlet is filled with shower water from the group of sprinkling water holes and thereby air entrainment is prevented and a straight water spouting formed of a single line-like regulated water flux without disarray in the water flow.

This water spouting device may be configured such that in the group of sprinkling water holes for the shower, the water spouting is performed at an angle in an outward-looking manner in a direction at a right angle relative to a shaft, and the water spouting from the water spouting outlet is performed at an angle in an inward-looking manner in the direction at a right angle relative to the shaft. As a result, the shower spouting from the group of water sprinkling holes for the shower and the water spouting from the water spouting outlet surrounding the periphery thereof neatly interflow and the straight water spouting formed of a single line-like regulated water is preferably formed.

In the device of the present invention, the group of water sprinkling holes for the shower serves as a water spouting outlet for the shower spouting and that for the straight water spouting outlet.

Accordingly, a water spouting area (water spouting space) for the shower spouting and the straight water spouting can be widely obtained and thereby a comfortable shower spouting and straight water spouting can be realized.

Accordingly, the problems such as that in the conventional water spouting device, in which the entire water spouting device is large sized because each of the shower spouting outlet and the straight water spouting outlet occupies separate space, is solved. In addition, the water spouting device can be compact sized and an appearance can be preferably formed. Further, design flexibility can be increased.

BRIEF DESCRIPTION OF THE DRAWINGS

FIG. 1 is an illustration showing a kitchen equipped with a kitchen water faucet with respect to the first embodiment according to the present invention;

[FIG. 2]

[FIG. 3]

[FIG. 4]

[FIG. 5]

FIG. 6 is an exploded cross-section showing the water spouting device;

FIG. 7 is an exploded perspective view showing the water spouting device;

[FIG. 8]

[FIG. 9]

[FIG. 10]

[FIG. 11]

[FIG. 12]

[FIG. 13]

FIG. 14 is a longitudinal cross-section showing the water spouting device with respect to the third embodiment;

[FIG. 15]

[FIG. 16]

FIG. 17 is a longitudinal cross-section showing a conventional water spouting device;

[FIG. 18]

FIG. 19 is a longitudinal cross-section showing the water spouting device with respect to the sixth embodiment, when the shower spouting is performed;

FIG. 20 is a longitudinal cross-section showing the water spouting device when the straight water spouting is performed;

FIG. 21 is an exploded perspective view showing the water spouting device of FIG. 17; and

FIG. 22 is a bottom plan view showing the water spouting device of FIG. 17.

BEST MODE FOR CARRYING OUT THE INVENTION

Hereinbelow, the first embodiment of the present invention will be explained on the basis of FIGS. 1 through 12B in detail.

Figure 1:
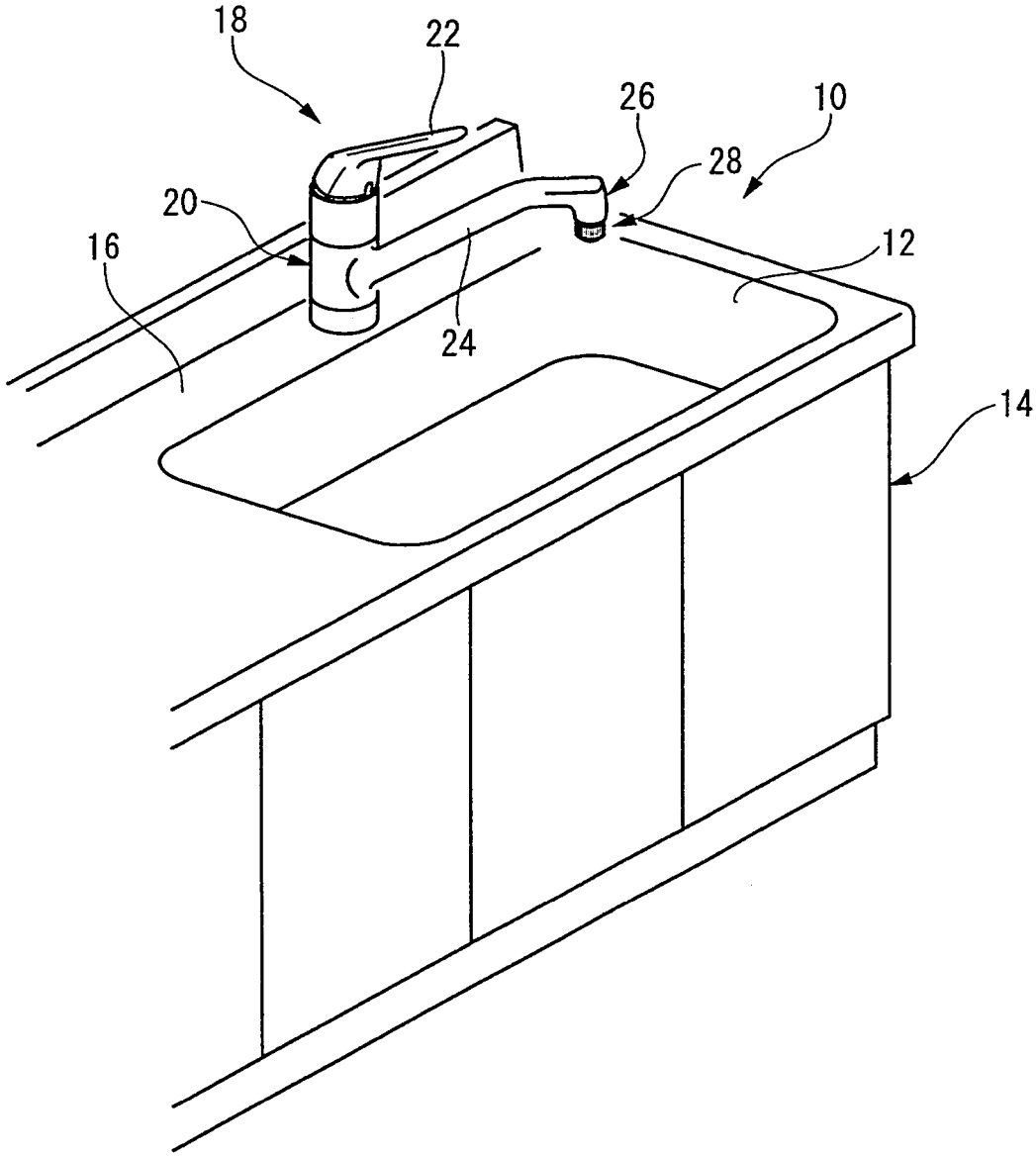
[FIG. 1]

In FIG. 1, the numeral 10 denotes a kitchen sink, the numeral 12 denotes a sink, the numeral 14 denotes a cabinet, and the numeral 16 denotes a counter, and a kitchen water faucet (water faucet facility) 18 is equipped on the counter 16.

The kitchen water faucet 18 is a single-lever-type combination faucet, and the numeral 20 denotes a main body of the water faucet. An operating lever 22 is provided at an upper portion thereof, to be rotatable in a left-and-right direction and an up-and-down direction.

A water spouting tube 24 is extending forward in an upward direction above the sink 12 from the water faucet main body 20, and a water spouting device 28 of the present embodiment is provided on a water spouting head 26 at a tip end portion of the water spouting tube 24.

An entire construction of the water spouting device 28 is shown in FIGS. 2A, 2B, 3A, and 3B.

As shown in the drawings, the water spouting device 28 is configured to be detachable from an opening portion 30 for a water spouting outlet of the water spouting head 26.

The numeral 32 denotes a joint main body in the water spouting device 28, and an upper end portion of the joint main body 32 is attached to the opening portion 30 by means of a screw ring 34 that serves as a connecting device.

In detail, a female screw is formed in an inner peripheral surface of the screw ring 34 and a male screw is formed in an outer peripheral surface thereof. The male screw in the outer peripheral surface is screwed into a female screw formed in an inner peripheral surface of the opening portion 30, and a male screw formed in an outer peripheral surface at an upper end portion of the joint main body 32 is screwed into the female screw formed in the inner peripheral surface of the screw ring 34.

Thereby, the joint main body 32 is combined with the opening portion 30 via the screw ring 34 in a screw-combination manner.

A sheet-shaped sealing member 40 is interposed between the screw ring 34 and the water spouting head 26, and space between the same is water-tightly sealed by means of the sealing member 40.

An upper portion of the joint main body 32 is formed to be a cylinder shape having a hole 48. At a lower portion of the joint main body 32, a plurality of penetrating openings 46 is extending in a direction in parallel with an axial direction of the cylinder. The penetrating openings 46 are opened at a bottom face of the hole 48, and an upper end face and a lower end face of the joint main body 32 are allowed to communicate with each other via the hole 48 and the penetrating openings 46.

A step portion is formed at an upper edge of the hole 48, and a mesh 38 is hooked at the step portion. The mesh 38 is disposed in a manner so as to traverse the hole 48.

At a center of the lower portion of the joint main body 32, a fitting opening 44 that penetrates in an axial direction of the joint main body 32 is formed. In a manner so as to extend the fitting opening 44, a short cylinder portion 42 is protruding upward from the bottom face of the hole 48. An internal portion of the cylinder portion 42 also constitutes part of the fitting opening 44.

The water spouting device 28 is provided with a water sprinkling member 50, a tube member 52, and an operating ring (operating member) 54 other than the joint main body 32.

The aforementioned water sprinkling member 50 is provided with a shaft portion 56 at a center thereof, as shown in FIGS. 6, 7, 10A, and 10B, and the shaft portion 56 is slidably fitting into the fitting opening 44 at the center part of the joint main body 32, in an upper and lower direction, i.e., in a shaft direction in the drawing.

To an upper end of the shaft portion 56, a stopping ring 58 is attached, and the water sprinkling member 50 is prevented from being pulled out downward from the joint main body 32 in the drawing, resulting from contacting of the stopping ring 58 with an upper end of the cylinder portion 42.

At a lower end portion of the shaft portion 56, a water sprinkling plate 60, in which a flat-plate-like plane shape is formed to be a circular shape, is integrally formed therewith.

Figure 10A:
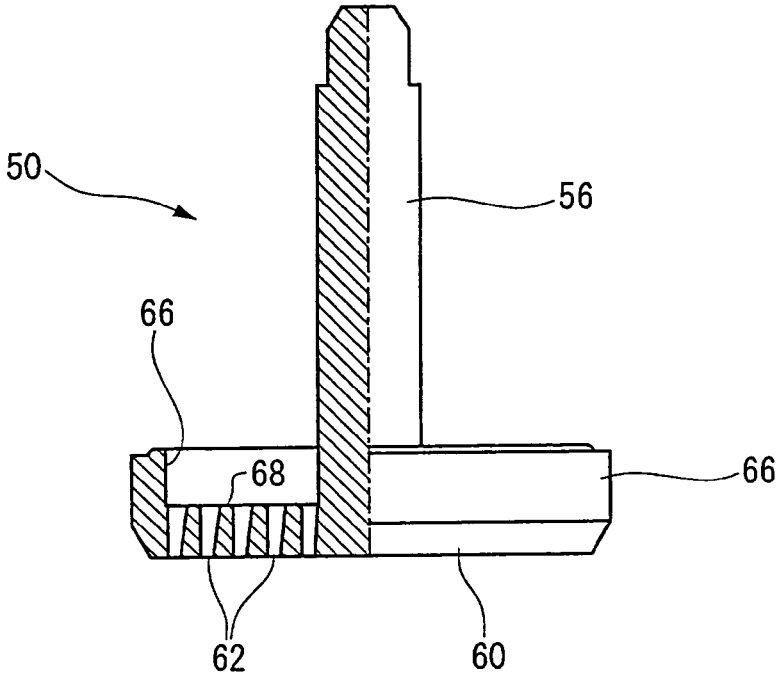
FIG. 10A is a side elevation showing a water sprinkling member, the left half of which is showing a longitudinal cross-section.
Figure 10B:
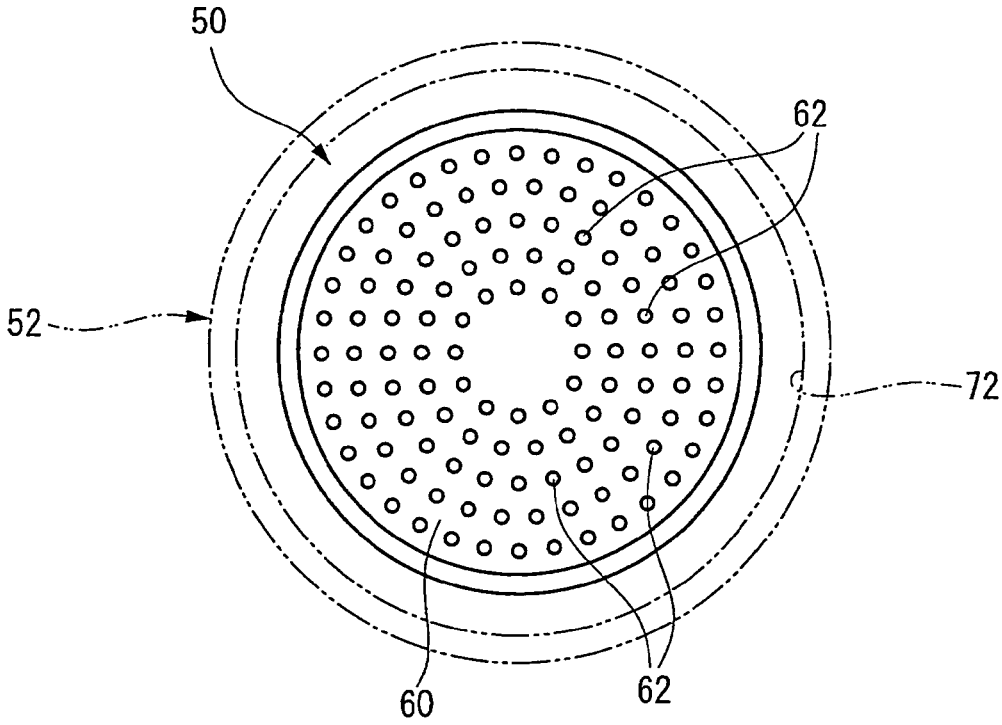
FIG. 10B is a bottom plan view showing the water sprinkling member.
Figure 11A:
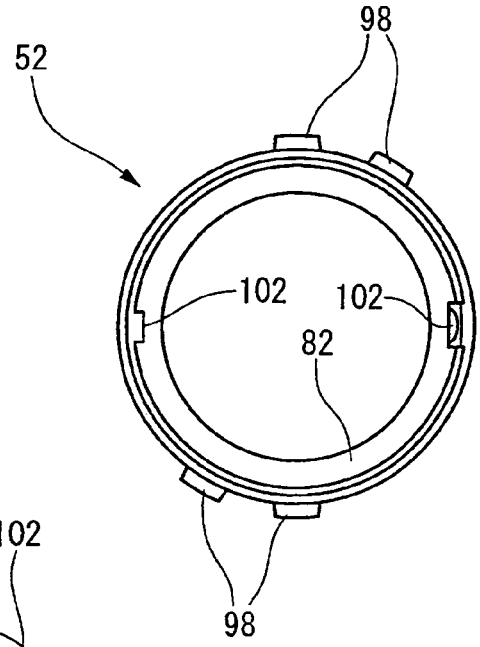
FIG. 11A is a plan view showing a tube member.
Figure 11B:
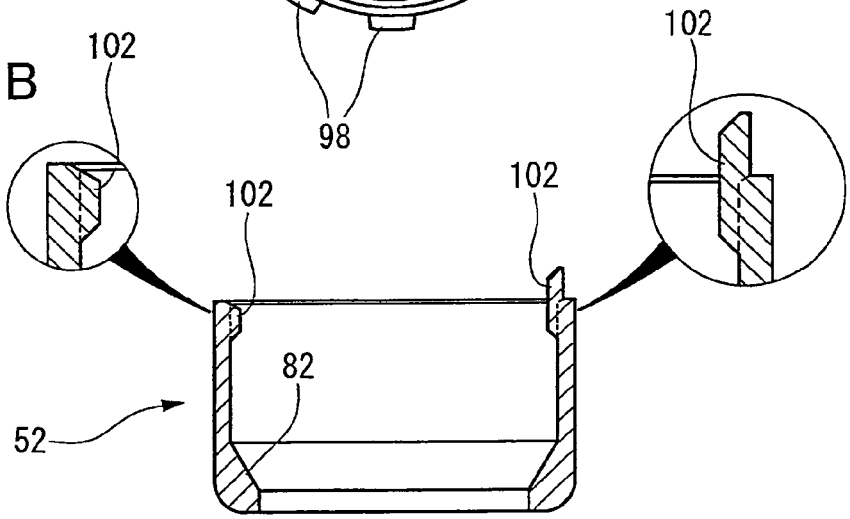
FIG. 11B is a cross-section along XIB-XIB line of FIG. 11A.
Figure 11C:
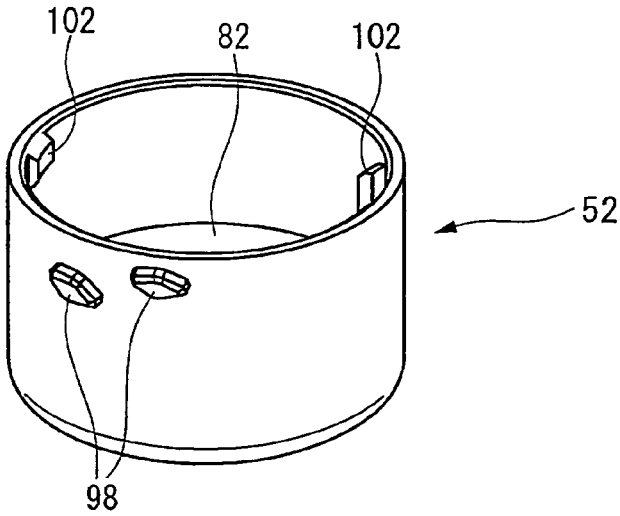
FIG. 11C is a perspective view showing the tube member.

In the water sprinkling plate 60, a plurality of water sprinkling holes 62 formed of small holes is disposed in a manner so as to be dispersed, as also shown in FIGS. 10A and 10B.

At an outer peripheral portion of the water sprinkling plate 60, a circular bank portion 66 is formed in a rising upward manner in the drawing, and at an inside of the bank portion 66, a concave portion 68 is formed.

In addition, the water flows into the water sprinkling holes 62 from a center hole 36 of the water spouting head 26 by means of the concave portion 68, the aforementioned hole 48 in the joint main body 32, a penetrating opening 46, and the like.

The tube member 52 has a cylindrical shape having an inner hole 72, as also shown in FIGS. 7, and 11A through 11C, and a circular ring-shaped water spouting outlet 74 for the straight water spouting is formed between the inner hole 72 and the water sprinkling plate 60 of the water sprinkling member 50, in other words, in a manner so as to surround all over the periphery of a group of water sprinkling holes 62.

Figure 2A:
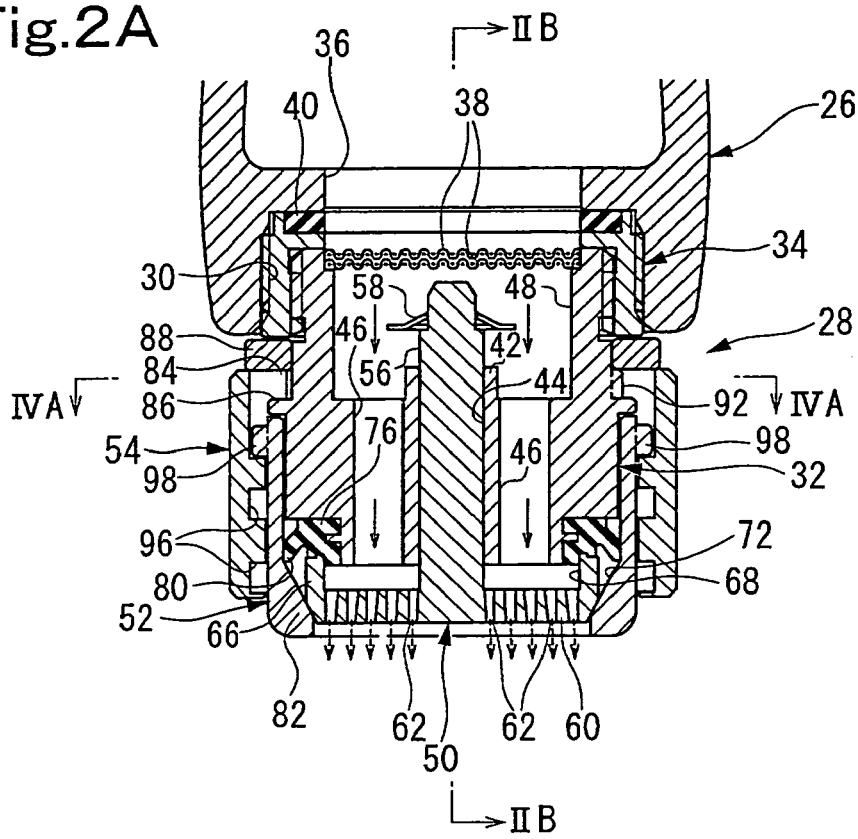
FIG. 2A is a longitudinal cross-section showing a water spouting device in a condition of shower spouting with respect to the embodiment of the present invention.
Figure 2B:
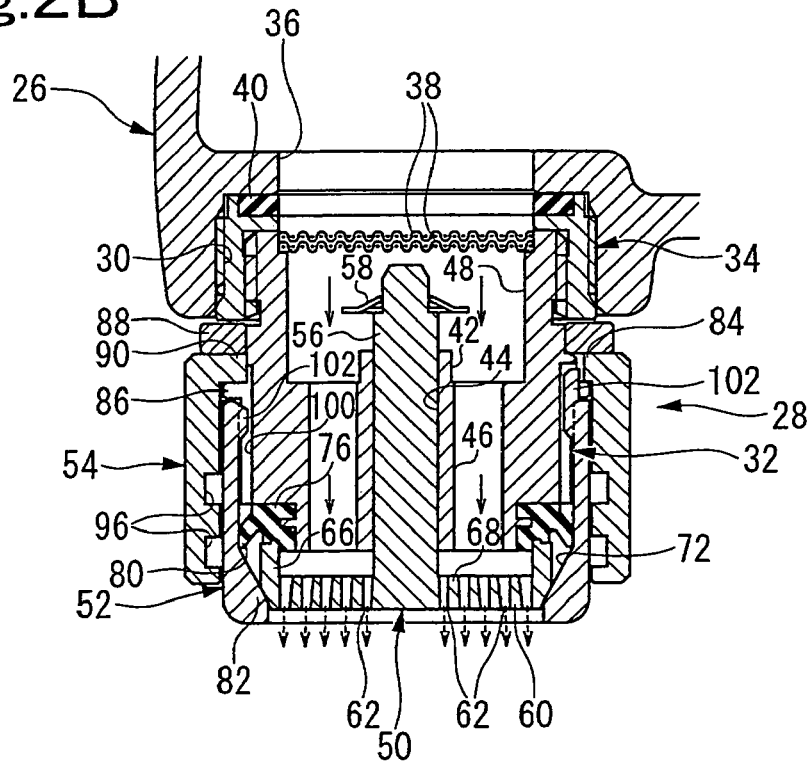
FIG. 2B is a cross-section along IIB-IIB line of FIG. 2A.

As shown in FIGS. 2A and 2B, the water flow to the water spouting outlet 74 is interrupted by means of raising the water sprinkling member 50 upward in the drawing, and seating of the bank portion 66 on the sealing member 76 being mounted on the joint main body 32.

Figure 3A:
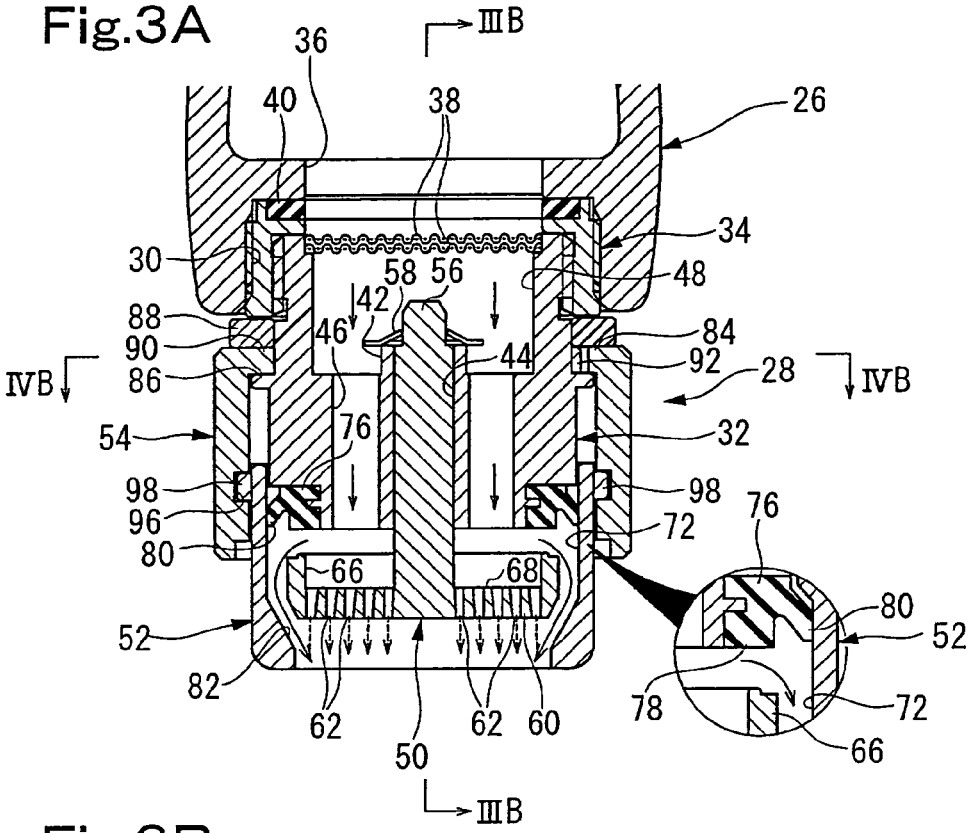
FIG. 3A is a longitudinal cross-section showing the water spouting device in a condition of straight water spouting with respect to the embodiment of the present invention.
Figure 3B:
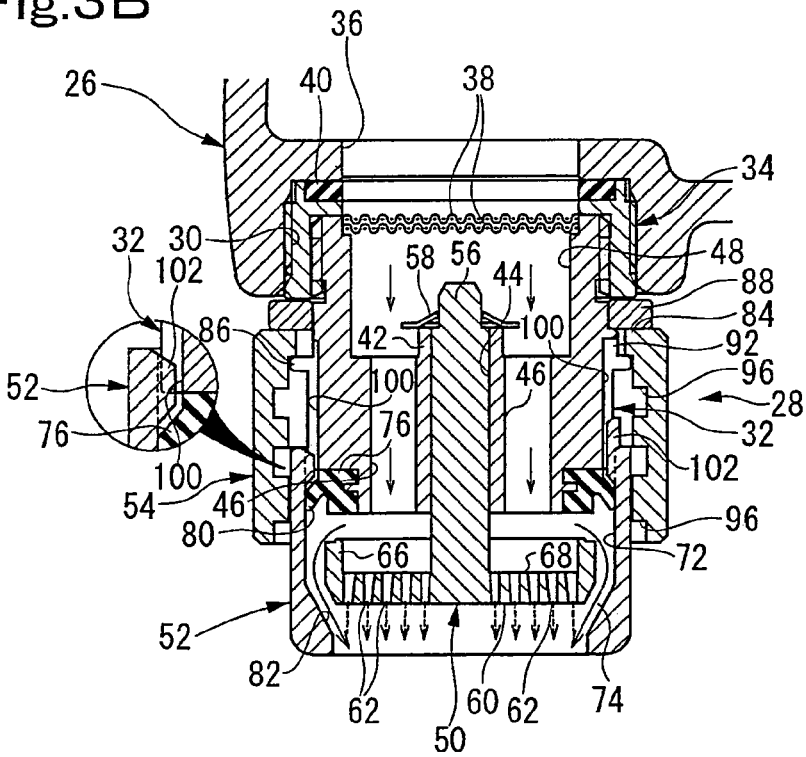
FIG. 3B is a cross-section along IIIB-IIB line of FIG. 3A.

When the water sprinkling member 50 moves downward in the drawing from the condition shown in FIGS. 2A and 2B to that shown in FIGS. 3A, and 3B and the bank portion 66 is separated from the sealing member 76 thereby forming an interspace therebetween, the water spouting outlet 74 is opened.

At this moment, the entire sealing member 76 has a ring block shape, and an upper end of the bank portion 66 of the water sprinkling member 50 is able to contact a bottom face of the sealing member 76. The sealing member 76 is provided with a lip portion 80 that elastically contacts an inner peripheral surface of the tube member 52.

Namely, the sealing member 76 has a function capable of water-tightly sealing the space between the joint main body 32 and the bank portion 66 of the water sprinkling member 50, and a function capable of water-tightly sealing the space between the joint main body 32 and the tube member 52.

The sealing member 76 is fixed to the joint main body 32 by means of adhesion.

The water sprinkling member 5Q is configured to be capable of moving up and down at a predetermined stroke relative to the joint main body 32, namely capable of moving up and down in a shaft direction, while sliding the shaft portion 56 up and down at an inner part of the fitting opening 44.

A lower end portion of the tube member 52 serves as an inverted tapered portion 82 having a shape corresponding to a tapered shape of the outer peripheral portion of the water sprinkling plate 60 of the water sprinkling member 50, and the inverted tapered portion 82 is configured to contact the outer peripheral portion of the water sprinkling plate 60 and to raise the water sprinkling member 50 upward in the drawing, while rising.

The tube member 52 is fitting upon a lower part of the joint main body 32 in a manner so as to be movable in an up-and-down direction. A length of a stroke of the tube member 52 in the up-and-down direction is greater than the length of the stroke of the water sprinkling member 50.

The operating ring 54 has an inward-looking flange portion 84 at an upper end portion thereof, as shown in FIGS. 6, 7, 9A, 9B, and 9C, and the flange portion 84 is rotatably supported by means of an outward-looking flange portion 86 of the joint main body 32.

The flange portion 84 is sandwiched between the flange portion 86 of the joint main body 32 and a C-ring-shaped spacer member 88 from above and below, and the operating ring 54 is not moved in an up-and-down direction.

A rotating dimension of the operating ring 54 around an axis is limited within a certain dimension.

For details, a stopper portion 90 is formed in an inner periphery of the flange portion 84 of the operating ring 54, as shown in FIGS. 4A, 4B, 7, 9A, 9B and 9C, and by means of contacting of the stopper 90 with an end faces 92*a* and 92*b* of the stopper portion 92 formed in the joint main body 32, a rotating position is configured to be limited.

At the outer peripheral surface of the joint main body 32, a protruding stopper portion 92 extending across an area of an angle of about 205° in a peripheral direction, and a flat portion 93 extending across an area of an angle of about 155° are provided.

The flat portion 93 is extending in a peripheral direction of the stopper portion 92 from one end face 92*a* to the other end face 92*b*.

The stopper portion 90 of the operating ring 54 is disposed at the flat portion 93. The stopper portion 90 is extending across a dimension at an angle of about 45° in a peripheral direction. Accordingly, it is possible for the operating ring 54 to rotate only in a dimension of an angle of about 110°, as indicated by a Greek letter θ in FIG. 4A.

In an inner peripheral surface of the operating ring 54, two streaks of helical grooves 96 are formed, as shown in FIGS. 5A, 5B, 6, and 9A through 9C.

In an outer peripheral surface of an upper end portion of the aforementioned tube member 52, protruding portions 98 that protrudes in an outward looking manner in a radial direction is formed, as shown in FIGS. 5A through 7, and 11A through 11C, and these protruding portions 98 are slidably engaged with and along the two streaks of helical grooves 98.

These helical grooves 96 and the protruding portions 98 constitute a screw-advancing mechanism, and when the operating ring 54 is rotatingly operated, the tube-member 52 is moved in an up-and-down direction in the drawing by means of sliding of the protruding portions 98 and the helical grooves 96.

So as not to integrally rotate the tube member 52 with the operating ring 54, a mechanism for suppressing rotation of the tube member 52 is provided between the tube member 52 and the joint main body 32.

For details, a key groove 100 that is extending in an up-and-down direction in the drawing is formed in the joint main body 32, as shown in FIGS. 2B, 3B, 6 through 8C, 11A, 11B, and 11C. In the tube member 52, a slide key 102 that protrudes in an inward looking manner in a radial direction is provided at an upper end portion thereof and the slide key 102 is slidably engaged with the key groove 100. Thereby, the tube member 52 is engaged with the joint main body 32 in an unable manner for rotation relative to the joint main body 32.

Next, operation of the water spouting device 28 of the present embodiment will be explained.

Shower Spouting

Figure 4A:
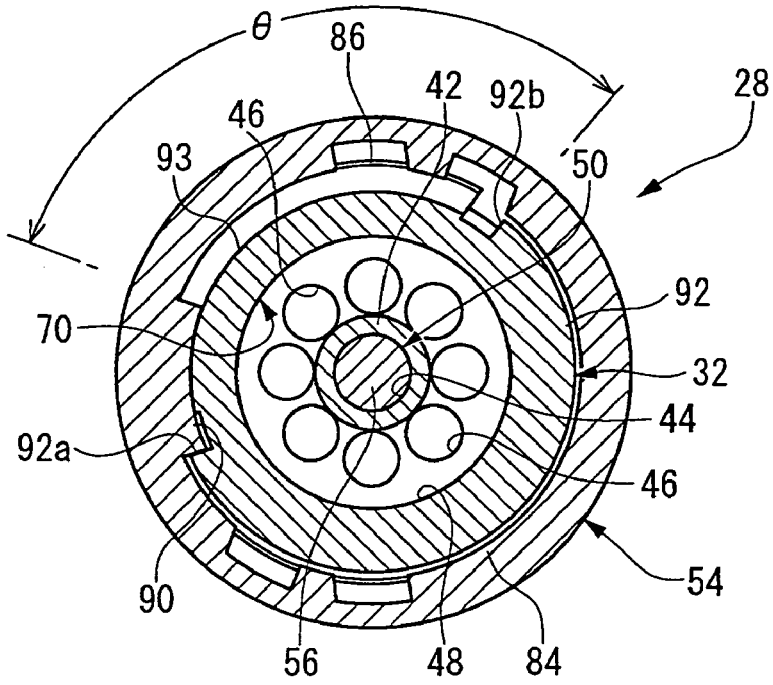
FIG. 4A is a cross-section along IVA-IVA line of FIG. 2A.

FIGS. 2A, 2B, 4A, 5A, and 12A show a condition when a shower spouting is performed, and at this time, the stopper portion 90 of the operating ring 54 is in a condition of being in contact with one end portion 92*a* of the stopper portion 92 of the joint main body 32, as shown in FIG. 4A. At this time, both the water sprinkling member 50 and the tube member 52 are located at a raised position, as shown in. FIG. 2A, and the water spouting outlet 74 is in a closed condition by means of contacting of the inverted tapered portion 82 with the outer peripheral portion of the water sprinkling plate 60 of the water spouting member 50.

In this condition, the water that flows down from the center hole 36 of the water spouting head 26 is introduced into only the water sprinkling holes 62, and only the shower spouting is performed in a downward-looking manner from that. At this time, an outer peripheral portion of the shower spouting is formed in a slightly outward-looking manner.

Figure 12A:
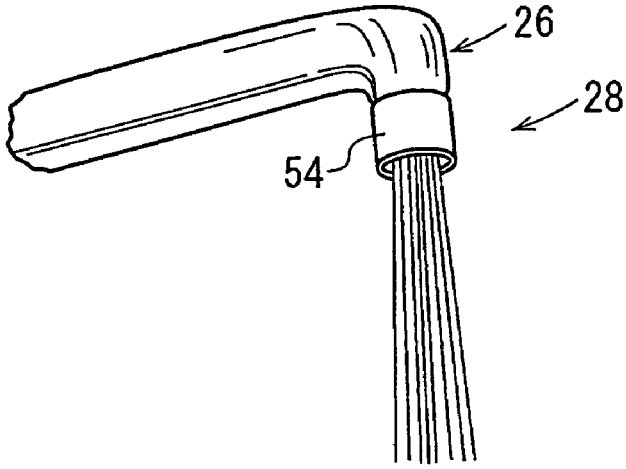
FIG. 12A is a perspective view showing a water sprinkling device when the shower spouting is performed.

FIG. 12A shows the condition when the shower spouting, in which the water is spouted only from the water sprinkling holes 62, is performed.

Switching Operation from Shower Spouting to Straight Water Spouting

Figure 4B:
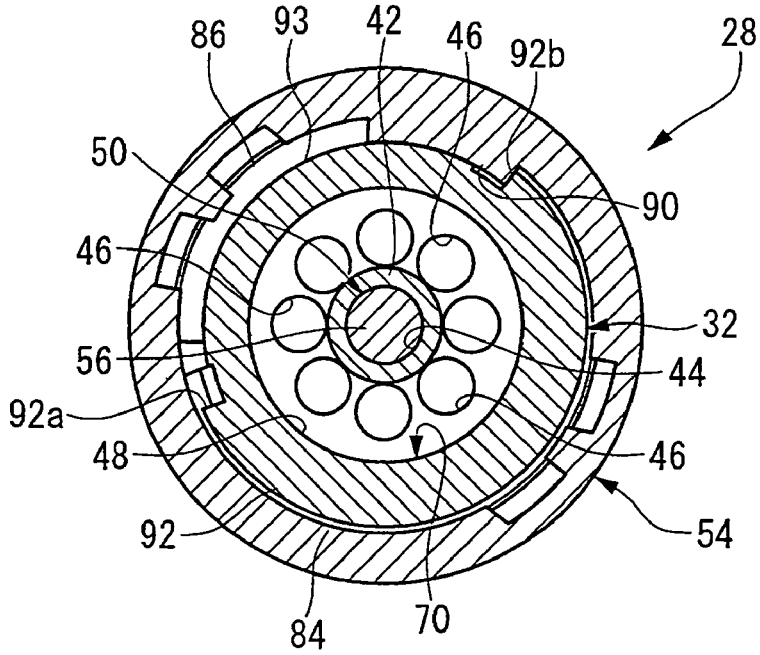
FIG. 4B is a cross-section along IVB-IVB line of FIG. 3A.
Figure 5A:
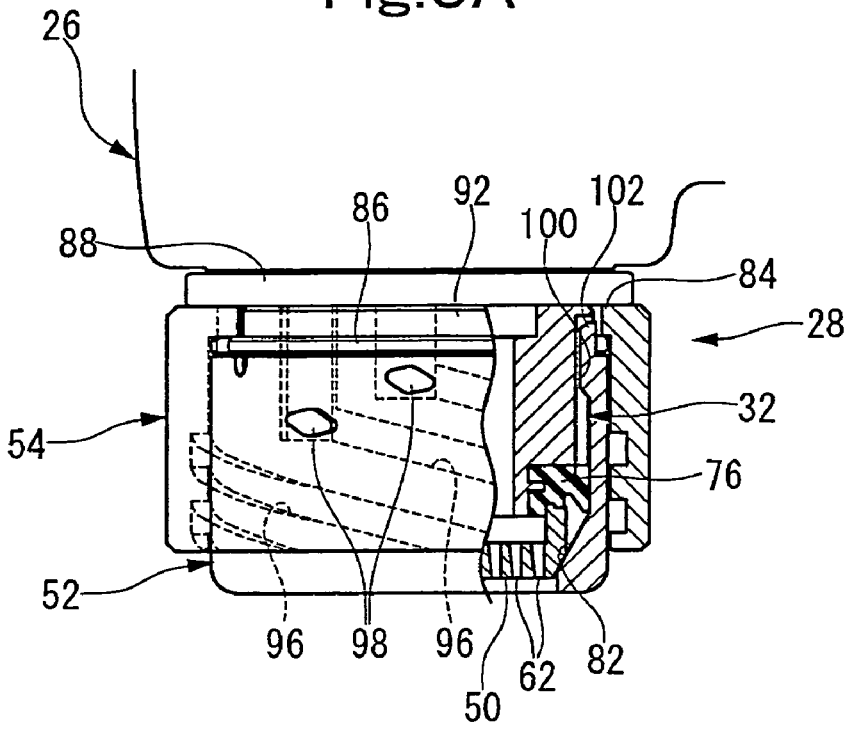
FIG. 5A is a partially broken side elevation showing the water spouting device when the shower spouting is performed.
Figure 5B:
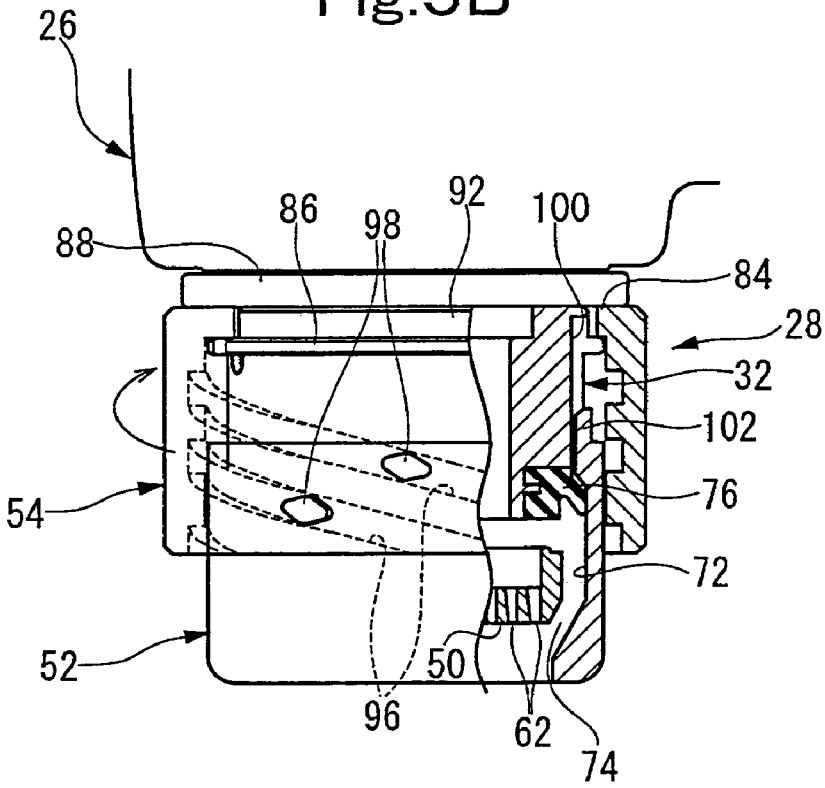
FIG. 5B is a partially broken side-elevation showing the water spouting device when the straight water spouting is performed.
Figure 6:
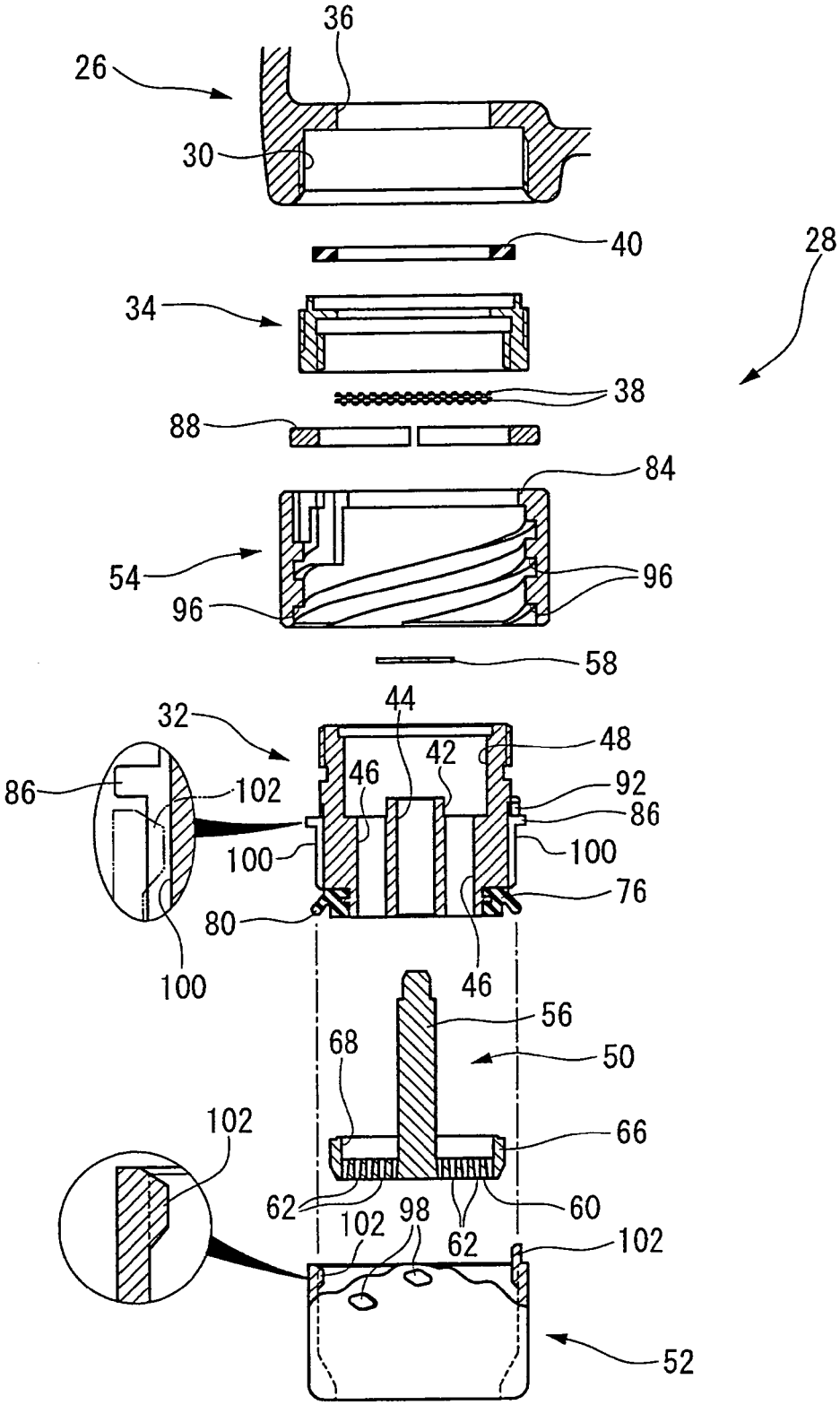
[FIG. 6]
Figure 7:
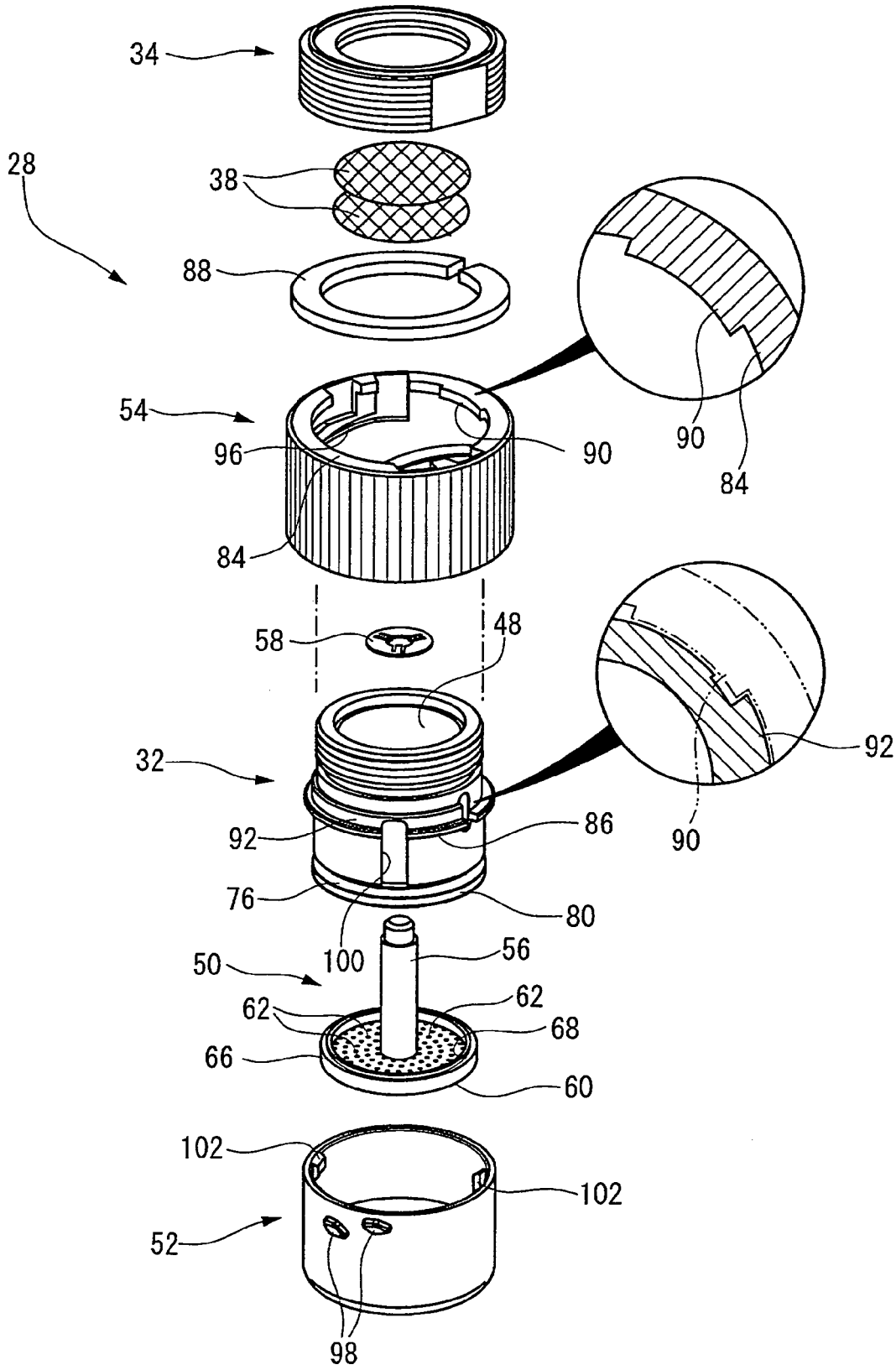
[FIG. 7]
Figure 8A:
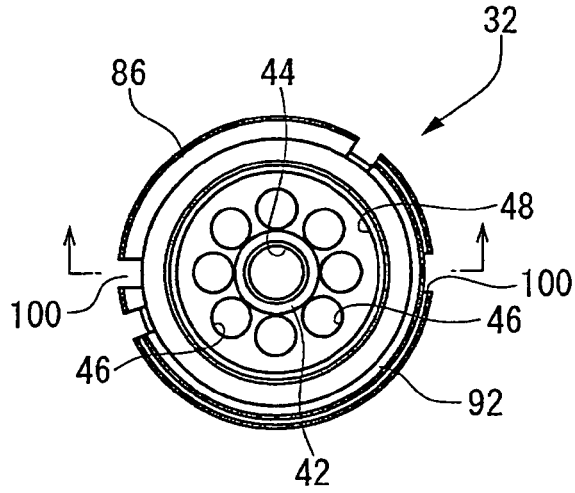
FIG. 8A is a plan view showing a joint main body.
Figure 8B:
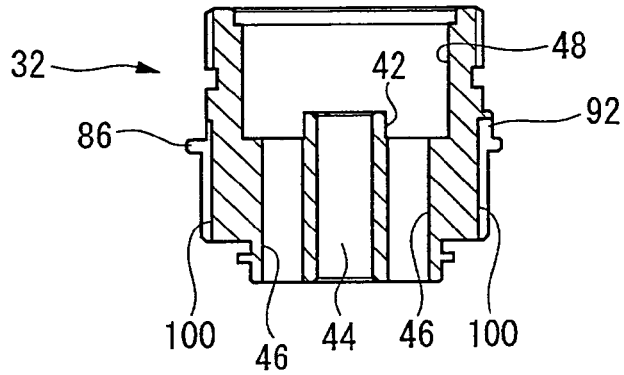
FIG. 8B is a cross-section along VIIIB-VIIIB line of FIG. 8A.
Figure 8C:
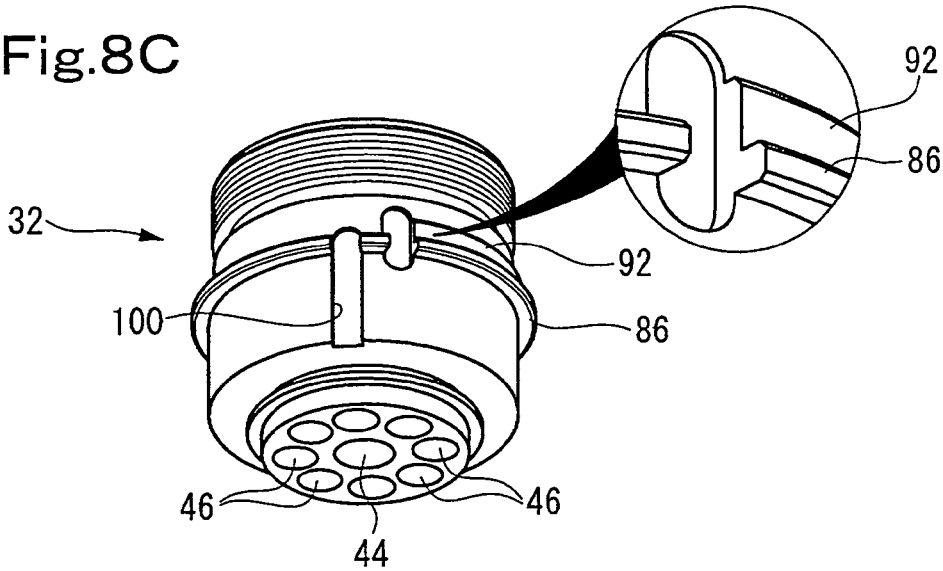
FIG. 8C is a perspective view showing the joint main body.
Figure 9A:
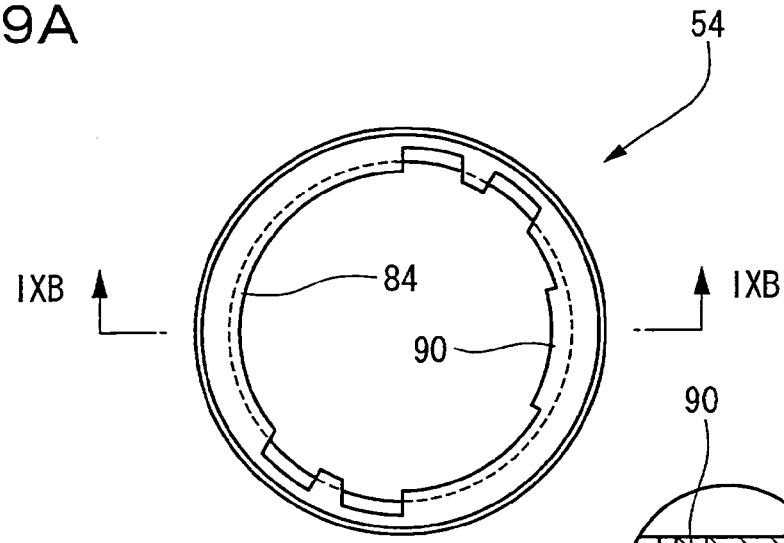
FIG. 9A is a plan view showing an operating ring serving as an operating member.
Figure 9B:
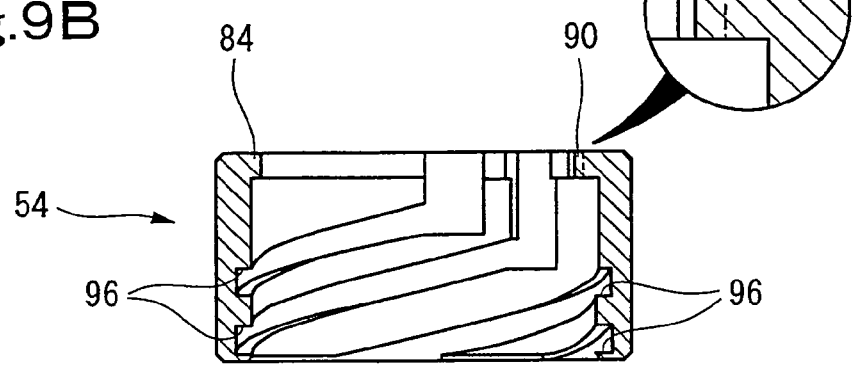
FIG. 9B is a cross-section along IXB-IXB line of FIG. 9A.
Figure 9C:
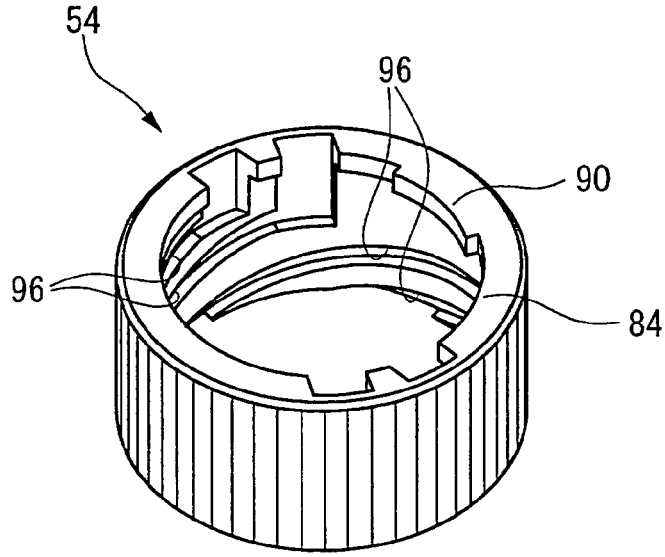
FIG. 9C is a perspective view showing the operating ring.

When the operating ring 54 is rotatingly operated in a clockwise direction in FIGS. 4A and 4B from this condition, the helical groove 96 of the operating ring 54 and the protruding portion 98 of the tube member 52 slide along each other, and the tube member 52 moves downward and the water sprinkling member 50 that is supported by means of the tube member 52 also moves down interlocking with the downward movement of the tube member 52 by own weight and operation of water pressure.

In the middle of the moving stroke of the tube member 52, the water sprinkling member 50 is stopped to move down due to contacting of the stopping ring 58 and an upper end of the cylinder portion 42 of the joint main body 32.

The tube member 52 continuously moves down from this condition, further. At a time point when the stopper portion 90 of the operating ring 54 comes into contact with the end portion 92*b* of the stopper portion 92 of the joint main body 32, as shown in FIG. 4B, the operating ring 54 stops and the tube member 52 also stops resulting in completing of the switching from the shower spouting to the straight water spouting.

Straight Water Spouting

This condition is the condition when the straight water spouting is performed, as shown in FIGS. 3A, 3B, 4B, 5B, and 12. At this time, an interspace is formed in an up-and-down direction between the bank portion 66 of the water sprinkling member 50 and the sealing member 76, as shown in FIGS. 3A and 3B, and another interspace is also formed between the inverted tapered portion 82 and the outer peripheral portion of the water sprinkling plate 60. Consequently, the water spouting outlet 74 is brought to a condition to be opened over an entire periphery.

Accordingly, the water is spouted from the water sprinkling holes 62 in the downward-looking manner, and part of the water moving downward through the penetrating openings 46 overflows the bank portion 66 of the water sprinkling member 50 and flows around an outer periphery side of the water sprinkling holes 62. Then, the part of the water flows into the water spouting outlet 74 and is spouted downward from the water spouting outlet 74.

At this time, both the spouting water from the water sprinkling hole 62 and that from the water spouting outlet 74 are simultaneously performed. The water spouting from the water sprinkling hole 62 and that from the circular ring-shaped water spouting outlet 74 integrally join and form a straight water spouting of a single line-like-regulated water flux, as shown in FIG. 12B.

Figure 12B:
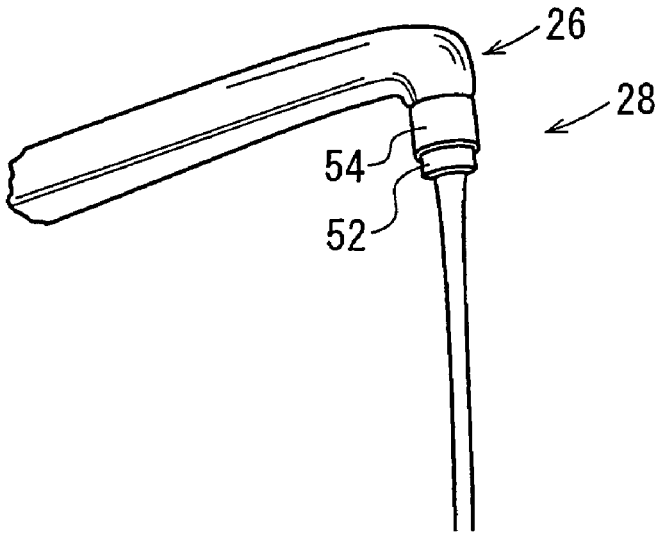
FIG. 12B is a perspective view showing the water sprinkling device when the straight water spouting is performed.

FIG. 12B shows a condition in which a straight water spouting with a single line-like regulated water flux is being formed by means of the spouting water from the water sprinkling hole 62 and that from the water spouting outlet 74.

As shown in FIG. 12B, the reason why the straight water spouting with the single line-like regulated water flux of even flow is formed is as follows.

When the water spouting from the water sprinkling hole 62 is simultaneously performed in addition to the water spouting from the water spouting outlet 74, an inside of the cylindrically shaped spouting water from the water spouting outlet 74 is brought to a condition of being filled with the spouting water from the water sprinkling hole 62, and the inside part of the spouting water from the water spouting outlet 74 is not brought to a condition of a cavity. Therefore, the water flows without air entrainment.

The spouting water from the inner hole 72 flows in a manner such that the lower the position of the spouting water is, the narrower the thickness of the spouting water is, because the spouting water is introduced into the inverted tapered portion 82. As a result, the cylindrically shaped water spouting flow that flows down while flowing out from the water spouting outlet 74 and that flows down while flowing out from the water sprinkling hole 62 neatly join together in the middle of the water spouting, and the straight water spouting with a single line-like regulated water flux is formed.

Switching Operation from Straight Water Spouting to Shower Spouting

When the water spouting is switched from the straight water spouting to the shower spouting, the operating ring 54 is rotatingly operated in a counterclockwise direction in FIG. 4B. Then, the tube member 52 moves upward first, and in the middle of the moving stroke, the inverted tapered portion 82 of the tube member 52 comes into contact with an outer peripheral surface of the water sprinkling member 50, and the tube member 52 and the water sprinkling member 50 moves upward together.

As shown in FIG. 4A, when the stopper portion 90 of the operating ring 54 comes into contact with the end portion 92*a* of the stopper portion 92, the switching operation from the straight water spouting to the shower spouting is completed. As described above, in the shower spouting condition, the upper end of the bank portion 66 of the water sprinkling member 50 is seated on the sealing member 76 attached to the joint main body 32, and the inverted tapered portion 82 is in contact with the outer peripheral surface of the water sprinkling member 50. Therefore, the water spouting outlet 74 is closed.

According to the water spouting device 28 of the present embodiment, the water sprinkling hole 62 serves as a water spouting function for the shower spouting and a function for infusing the water into the cylindrically shaped flowing-out water from the water spouting outlet 74 at a time when the water spouting for the straight water spouting is performed. Namely, the thus described shower spouting outlet is not constructed to be a thing just for the shower spouting outlet as the conventional water spouting device is. Accordingly, a water spouting area (water spouting space) for the shower spouting and the straight water spouting can be widely obtained and thereby a comfortable shower spouting and straight water spouting can be realized.

Further, along with this situation, there is no possibility, such as that an entire structure of the water spouting device becomes inevitably large sized because each of the shower spouting outlet and the straight water spouting outlet occupies separate space as in the conventional water spouting device. In addition, the water spouting device 28 can be compactly constructed and an appearance can be preferably formed. Further, design flexibility can be increased.

In the present embodiment, the shower spouting is performed by means of closing the water spouting outlet 74, and the straight water spouting is performed by means of opening the water spouting outlet 74. Accordingly, the shower spouting and the straight water spouting can be easily switched by means of a simple structure.

In the present embodiment, the water sprinkling member 50 provided with the water sprinkling hole 62 is configured to be movable in a shaft direction, and the water spouting outlet 74 is configured to be closed or opened by means of movement of the water sprinkling member 50. Therefore, closing or opening of the water spouting outlet 74 can be easily performed.

In the present embodiment, the sealing member 76 is configured to serve as both a sealing member between the joint main body 32 and the water sprinkling member 50, and a sealing member between the joint main body 32 and the tube member 52. Therefore, the required number of the sealing member can be decreased and the water spouting outlet 73 can be water-tightly closed in a preferable manner by means of seating the water sprinkling member 50 on the sealing member 76.

In the present embodiment, the tube member 52 can be moved in a shaft direction by means of only rotatingly operating the operating ring 54. Therefore, there is also an advantage such that operability is good.

Figure 13A:
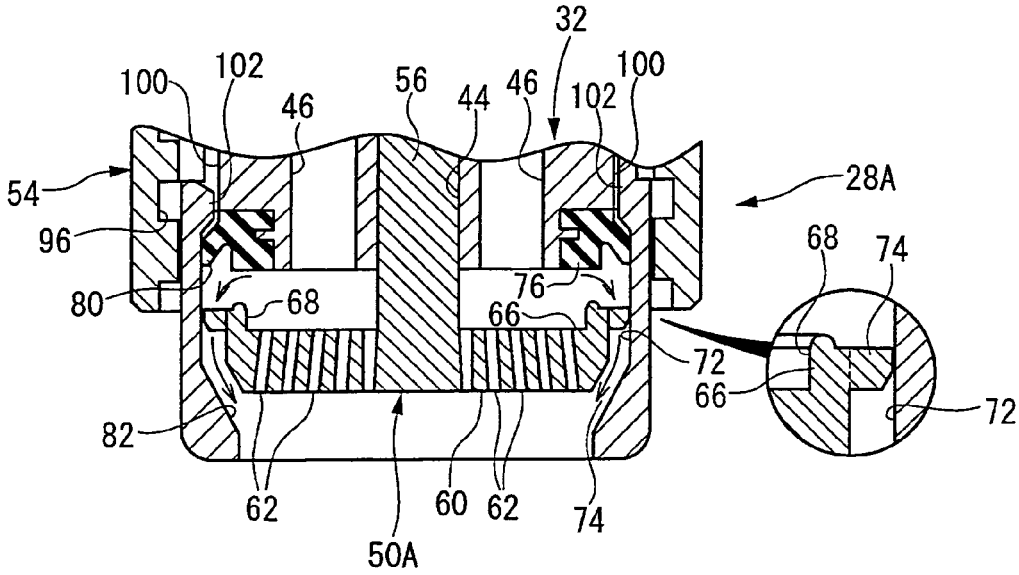
FIG. 13A is a longitudinal cross-section showing part of the water spouting device with respect to the second embodiment.
Figure 13B:
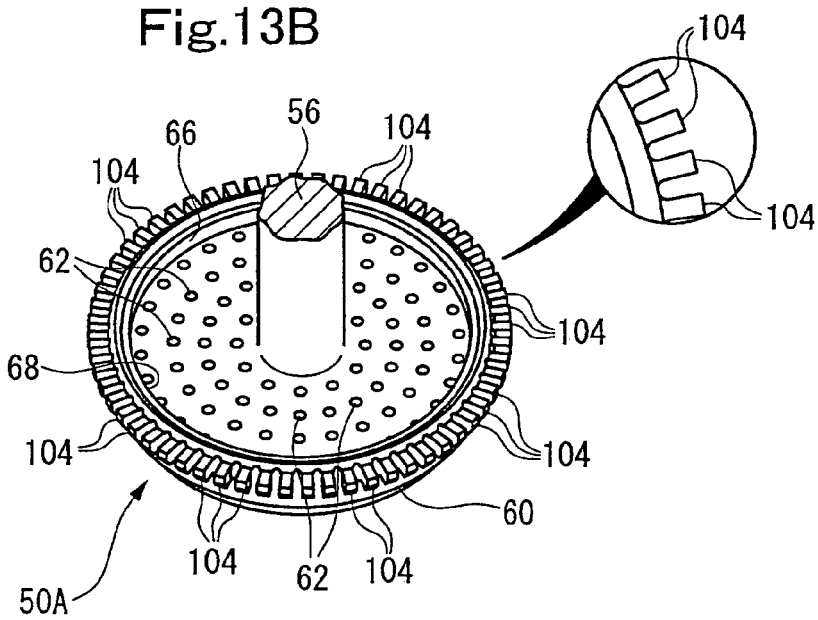
FIG. 13B is a perspective view showing the water sprinkling member of the water spouting device with respect to the second embodiment.

FIGS. 13A and 13B show a part of the water spouting device 28A with respect to the second embodiment of the present invention.

In this embodiment, a water flow regulating portion 104 is provided at an outer peripheral portion of the water sprinkling member 50A. This water flow regulating portion 104 is composed of a small projection protruding in a radial direction from the outer peripheral surface of the bank portion 66. The water flow regulating portion 104 is formed across an entire periphery of the outer peripheral surface of the bank portion 66 at constant intervals. Although a tip end of the water flow regulating portion 104 is slidably in contact with an inner peripheral surface of the inner hole 72, the same may be slightly spaced apart. Other construction of the water sprinkling member 50A is identical of that in the aforementioned water sprinkling member 50.

By means of providing the water flow regulating portion 104, a volume of water flow that flows out from the water spouting outlet 74 is brought to be even across a peripheral direction of the water spouting outlet 74 and the single line-like regulated water flux at a time of straight water spouting becomes stable.

In this embodiment, although the water flow regulating portion 104 is provided in the outer peripheral surface of the water sprinkling member 50A, the same may be provided in an inner peripheral surface of the inner hole 72.

Figure 14:
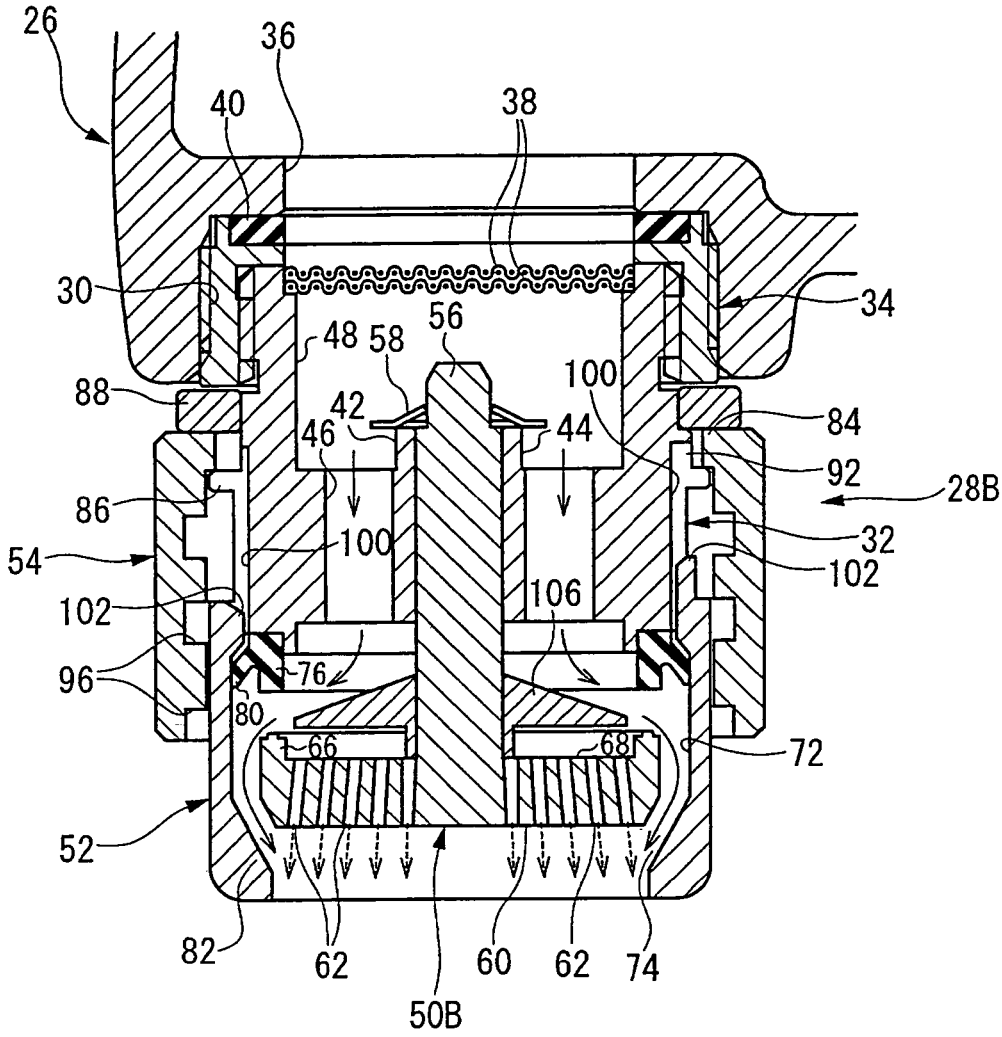
[FIG. 14]

FIG. 14 partially shows a water spouting device 28B with respect to the third embodiment of the present invention. In this embodiment, an umbrella-shaped guide member 106 is provided in the water sprinkling member 50B.

The guide member 106 is fitting upon the shaft portion 56, and an upper surface thereof has a down slope in a manner such as that the farther the position moves outward from the center, the lower the position becomes. An interspace having sufficient distance is formed between the guide member 106 and the bank portion 66, and between the guide member 106 and the water sprinkling plate 60, so that the water fully flows into each of the water sprinkling holes 62 flowing around the outer periphery of the guide member 106. The guide member 106 has a function to increase the volume of the water flowing into the water spouting outlet 74 at a time when the straight water spouting is performed and to stabilize the regulated water flow. Other construction of the water sprinkling member 50B, shown in FIG. 14, is identical of that in the aforementioned water sprinkling member 50.

Figure 15A:
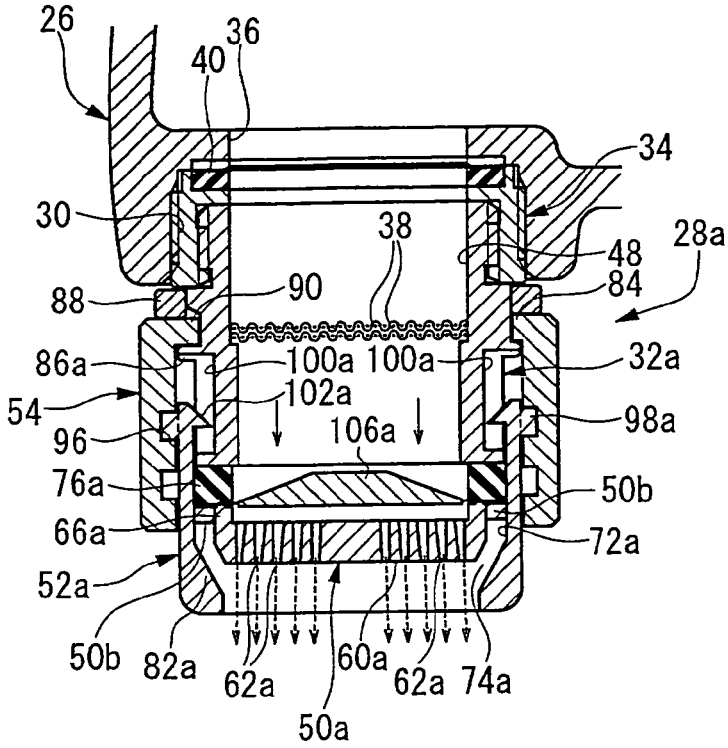
FIG. 15A is a longitudinal cross-section showing the water spouting device with respect to the fourth embodiment, when the shower spouting is performed.
Figure 15B:
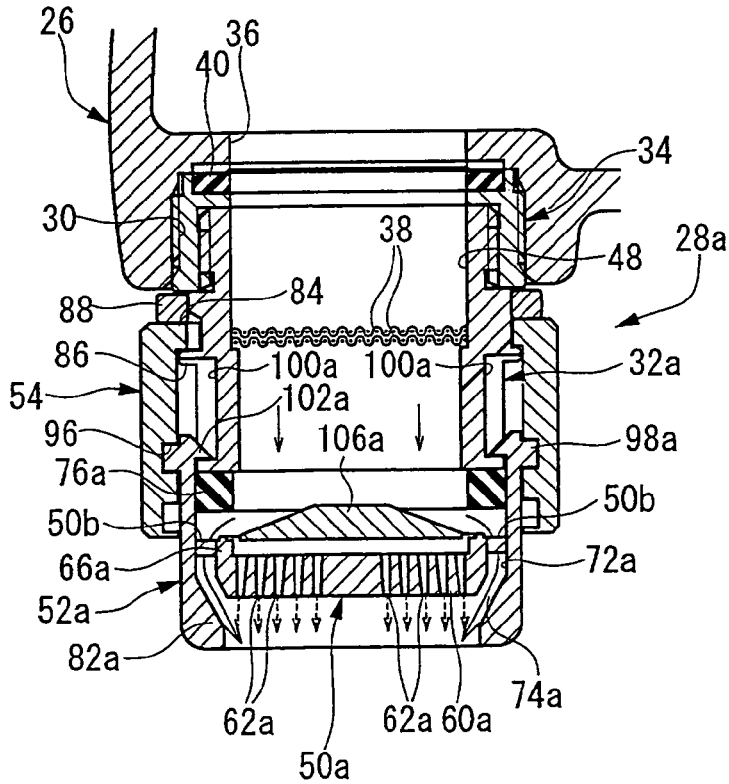
FIG. 15B is a longitudinal cross-section showing the water spouting device with respect to the fourth embodiment, when the straight water spouting is performed.

FIGS. 15A and 15B show the fourth embodiment of the present invention.

In this embodiment, the screw ring 34 is also screwed into the opening portion 30 of the water spouting head 26, and a water spouting device is attached to the screw ring 34.

The water spouting device 28*a* with respect to the present embodiment has a construction similar to that of the water spouting device 28, and the same elements are referred to by the same numerals and the elements having the same function with slightly different construction are referred to by the numerals attached with a suffix "a".

In the water spouting device 28*a*, a male screw is formed on an outer peripheral surface of an upper portion of a cylindrical joint main body 32*a*, and the male screw is screwed on a female screw of the inner peripheral surface of the screw ring 34.

An internal portion of the joint main body 32*a* serves as a hole that penetrates in an up-and-down direction, and a step portion is formed in the middle in the up-and-down direction of the internal portion. The mesh 38 is disposed in a manner so as to be hooked by the step portion.

A flange portion 86*a* is protruding from a middle portion in the up-and-down direction of an outer peripheral surface of the joint main body 32*a*. At a lower side from the flange portion 86*a*, a key groove 100*a* that extends in an up-and-down direction is formed.

A sealing member 76*a* is fixed to a lower end face of the joint main body 32*a* by means of bonding, or the like. This sealing member 76*a* is water-tightly and slidably in contact with the inner peripheral surface of the tube member 52*a*.

The tube member 52*a* is fitting upon the joint main body 32*a*. A slide key 102*a* is protruding from an inner periphery of an upper end portion of the tube member 52*a*. The slide key 102*a* is slidably engaged with the key groove 100*a* and thereby the tube member 52*a* is configured to be movable in the up-and-down direction relative to the joint main body 32*a*, and is fitting in a manner so as to be prevented from rotating in a peripheral direction.

A projecting portion 98*a* is protruding from the outer peripheral surface of the tube member 52*a*. The operating ring 54 is fitting upon the tube member 52*a*. The operating ring 54 has the same structure as that of the operating ring 54 in the aforementioned first embodiment. Namely, a flange portion 84 is protruding inward from the upper end portion of the operating ring 54, and the flange portion 84 is overlapped with the flange portion 86*a* of the joint main body 32*a* from above. Thereby, the operating ring 54 is engaged with the joint main body 32*a* in a manner so as to be rotatable in the peripheral direction.

The stopper portion 90 is protruding from an inner peripheral surface of the flange portion 86*a*. As is the same as that shown in FIGS. 4A and 4B, the stopper portion 90 is disposed in a flat portion 93 (the numerals are omitted in FIGS. 15A and 15B), and therefore the operating ring 54 is rotatable only within a dimension of an angle of θ degrees in FIG. 4A.

The spacer member 88 is interposed between the flange portion 86*a* and a lower end face of the screw ring 34, and thereby an upward movement of the operating ring 54 is prevented.

A projecting portion 98*a* protruding from an outer peripheral surface of the tube member 52*a* is engaged with the helical groove 96 formed on an inner peripheral surface of the operating ring 54. Thereby, when the operating ring 54 is rotated, the tube member 52*a* moves in an up-and-down direction similar to the above-described tube member 52.

In this embodiment, the tube member 52*a* and the water sprinkling member 50*a* are integrally formed and the both elements integrally moves up and down. The water sprinkling member 50*a* and the tube member 52*a* are connected to each other via a bridge portion 50*b*. The bridge portion 50*b* is disposed in a peripheral direction of an outer periphery of the water sprinkling member 50*a* in the plural number at even intervals. A part between each of the bridge portions 50*b* is formed to be open space, and is configured for the water to be able to flow downward through this space.

The water sprinkling member 50*a* has a circularly shaped water sprinkling plate 60*a*. A boss portion (not shown) is protruded from a center of the water sprinkling plate 60*a*, and a guide member 106*a* having an umbrella shape is fixed to an upper face of the boss portion.

In the water sprinkling plate 60*a*, numbers of water sprinkling holes 62*a* is penetrated. A bank portion 66*a* is peripherally formed at an upper face of an outer peripheral edge of the water sprinkling plate 60*a*. The aforementioned bridge portion 50*b* is protruding from an outer peripheral surface of the bank portion 66*a* in a radial direction.

An upper face of the guide member 106*a* is formed to be a down slope in a manner such that the farther the position on the upper face leaves from the center, the lower the position becomes. An interspace having sufficient distance is formed between the guide member 106*a* and the bank portion 66*a*, and between the guide member 106*a* and the water sprinkling plate 60*a*, so that the water fully flows into the water sprinkling holes 62*a*.

In the water sprinkling device 28*a*, as shown in FIG. 15A, when the condition is changed to that, shown in FIG. 4A, by rotating the operating ring 54, the tube member 52*a* and the integrally formed water sprinkling member 50*a* rise and the bank portion 66*a* comes in contact with a sealing member 74*a*. Consequently, the water from the water spouting head 26 flows out only from the water sprinkling hole 62*a* and the shower spouting is performed.

When the operating ring 54 is inversely rotated resulting in the condition of FIG. 4B, as shown in FIG. 15B, the tube member 52*a* and the water sprinkling member 50*a* lower and thereby the bank portion 66*a* is spaced apart from the sealing member 76*a*. Accordingly, the water passes through not only the water sprinkling hole 62*a*, but also the inner hole 72*a* between the water sprinkling member 50*a* and the tube member 52*a* and also flows out from the water spouting outlet 74*a* of the tube member 52*a*. Since the lower end portion of the inner hole 72*a* is formed of an inverted tapered portion 82*a* such that the lower the position is, the smaller the diameter is, the water flowing out from the water spouting outlet 74*a* flows out in a manner such that the lower the water advances, the smaller the diameter of the line of the flowing water becomes. Since the flowing-out water from the water sprinkling hole 62*a* is infused into inside of the flowing-out water from the water spouting outlet 74*a*, the spouting water from the water sprinkling device 28*a* becomes straight spouting water formed of the line-like regulated water.

Incidentally, in this embodiment, although a guide member 106*a* is provided, the guide member 106 can be omitted similarly to that in the first embodiment (Refer to FIGS. 1 through 12B).

Figure 16A:
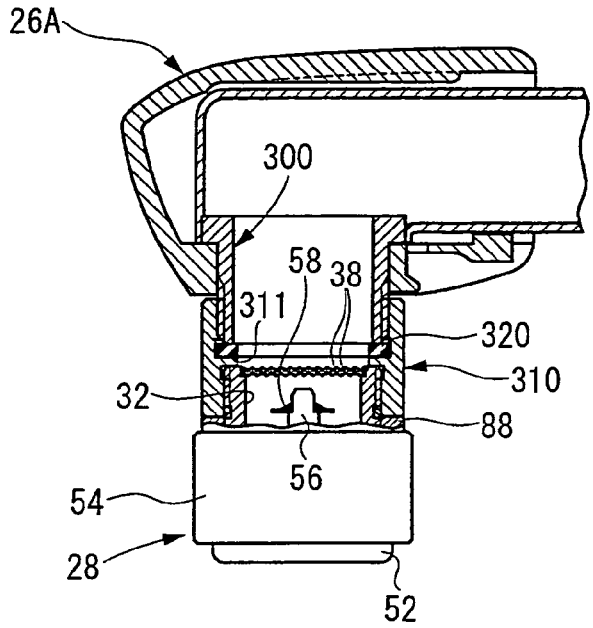
FIG. 16A is a side elevation showing the water spouting device with respect to the fifth embodiment, the upper portion of which is showing a longitudinal cross-section.
Figure 16B:
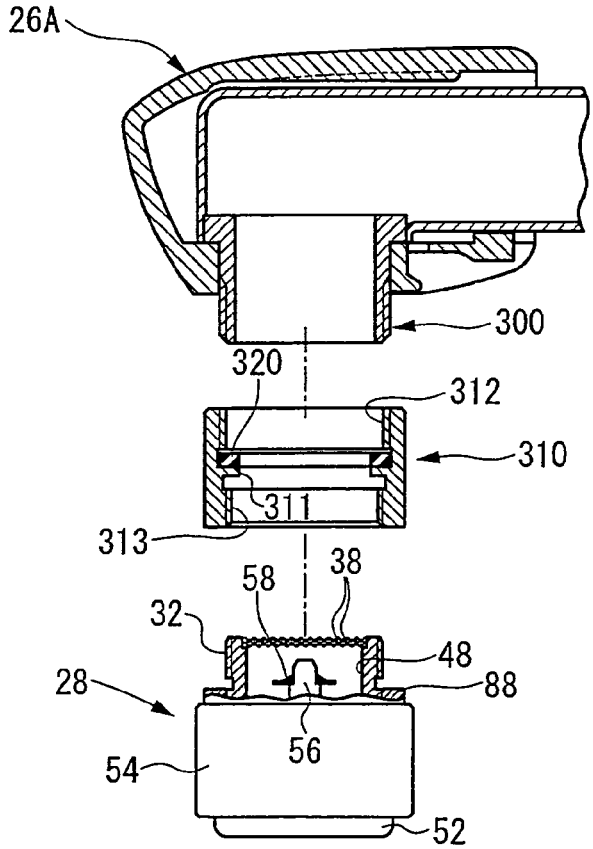
FIG. 16B is an exploded view showing the water spouting device with respect to the fifth embodiment.
Figure 17:
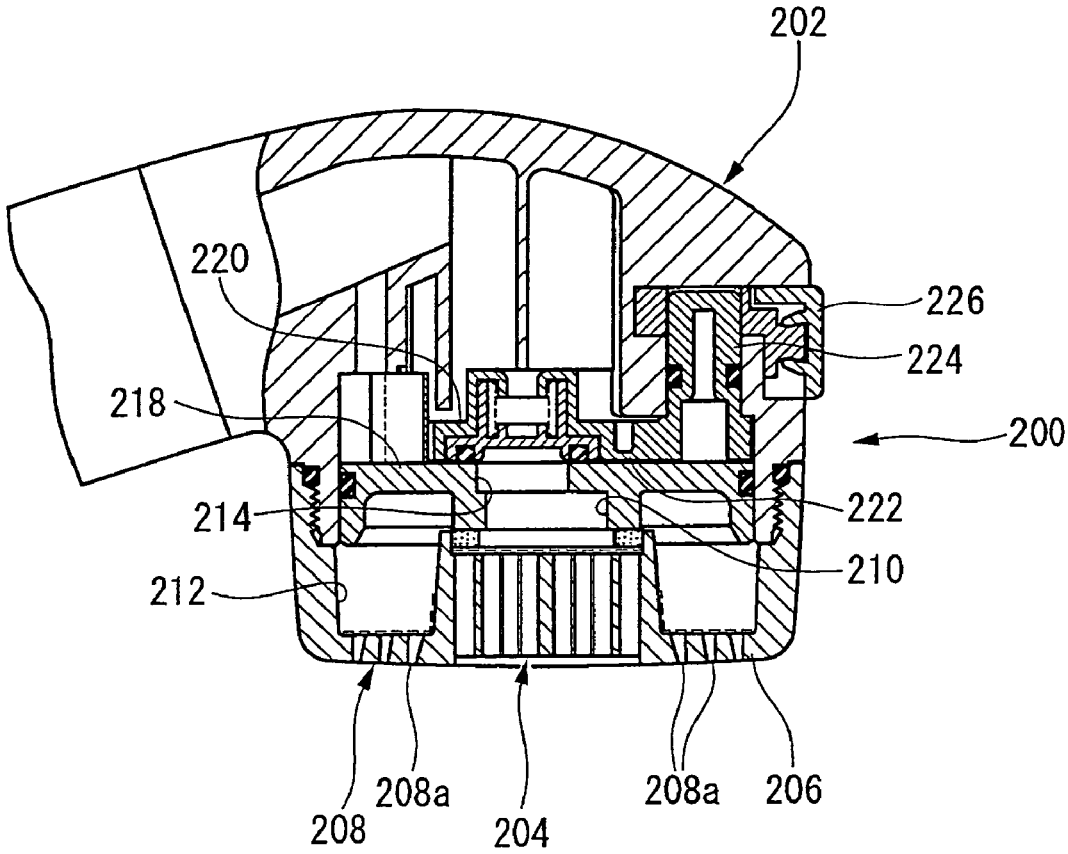
[FIG. 17]
Figure 18A:
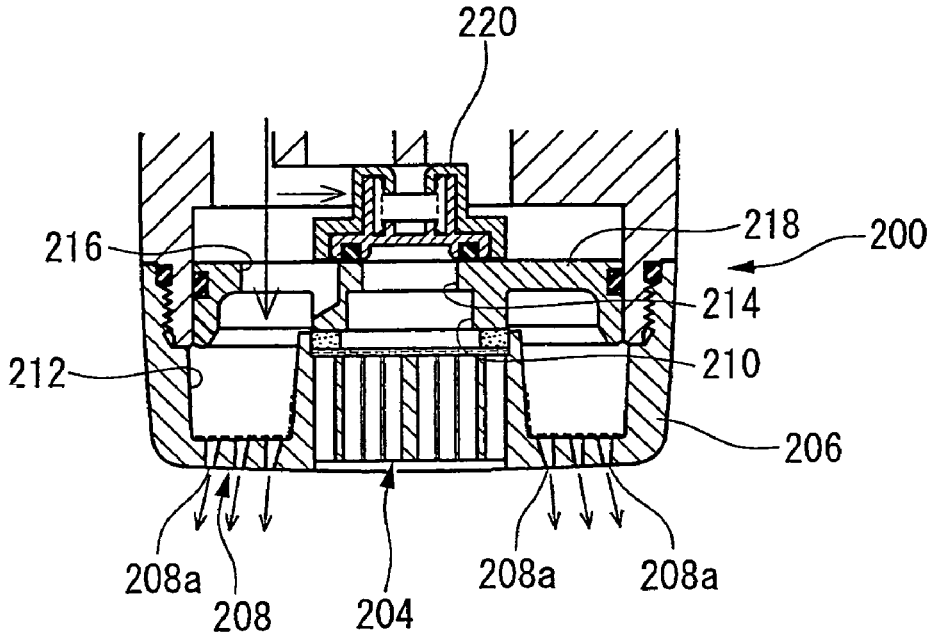
FIG. 18A is a cross-section showing the shower spouting of the water spouting device in FIG. 17.
Figure 18B:
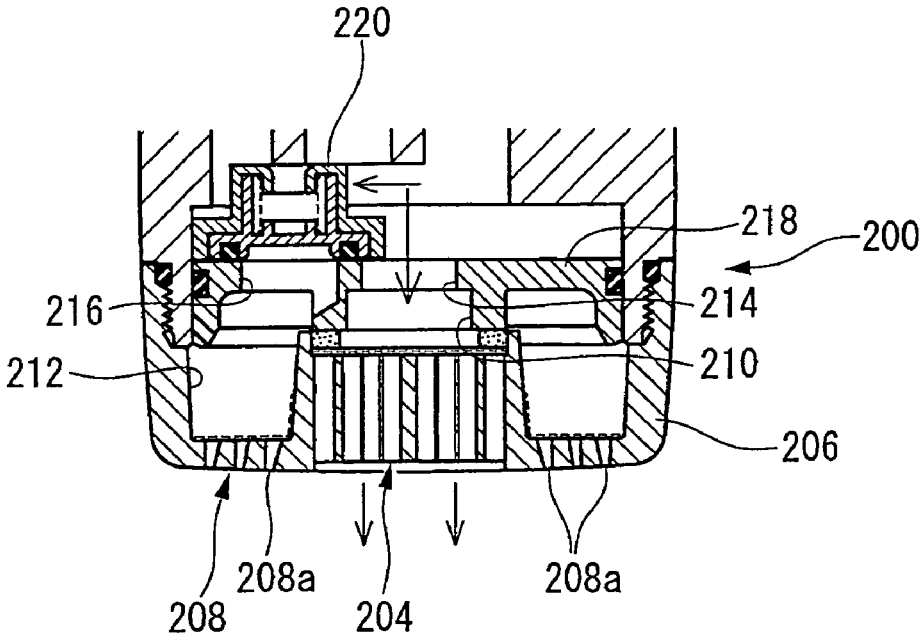
FIG. 18B is a cross-section showing the straight water spouting of the water spouting device in FIG. 17.

In the aforementioned embodiment, although a screw ring 34 is screw-fixed into an inner peripheral surface of the opening portion 30 of the water spouting head 26, as shown in FIGS. 2A through 3B, and the join t main body 32 is screw-fixed into an inner peripheral surface of the screw ring 34, a cylindrically shaped water spouting pipe 300 may be protruded from the water spouting head 26A, as shown in FIGS. 16A and 16B, and the joint main body 32 may be connected to this pipe 300 via a cylindrical joint 310.

A male screw 301 is formed on an outer peripheral surface of the lower portion of the pipe 300, and a female screw 312 of an inner peripheral surface of the upper portion of the cylindrical joint 310 is screwed on the male screw 301.

A brim portion 311 is protruded from the middle in an up-and-down direction of the inner peripheral surface of the cylindrical joint 310. A sealing member 320 is interposed between the brim portion 311 and a lower end of the pipe 300.

A female screw 313 is formed on the inner peripheral surface of the lower portion of the cylindrical joint 310, and the male screw of the outer peripheral surface of the upper portion of the joint member 32 is screwed into the female screw 313. A construction of the water spouting device 28 having this joint member 32 is identical of that in the aforementioned embodiment and the same numerals denote the same elements. Namely, in FIGS. 16A and 16B, the numeral 38 denotes the mesh, the numeral 52 denotes the tube member, the numeral 54 denotes the operating ring, the numeral 56 denotes the shaft portion, the numeral 58 denotes the stopping ring, and the numeral 88 denotes the spacer member. A usage of the water spouting device 28 is identical of that in the above-described embodiment.

FIGS. 19 through 22 show the sixth embodiment of the present invention.

A water spouting device 28C with respect to this embodiment also has a construction similar to that of the water spouting device 28, shown in FIGS. 1 through 12, and the elements having the same construction are referred to by the same numerals, and the elements having the same function with slightly different construction are referred to by the numerals attached with a suffix "C".

In this water spouting device 28C, a lever 400 is attached to an operating ring 54C.

The lever 400 is provided with a ring-shaped base ring 401 fitting upon the operating ring 54C in a concentric manner, a fixing ring 402 that fixes the base ring 401 to the operating ring 54C, a lever main body 403 extending sideward (in a radial direction) from the base ring 401.

Figure 19:
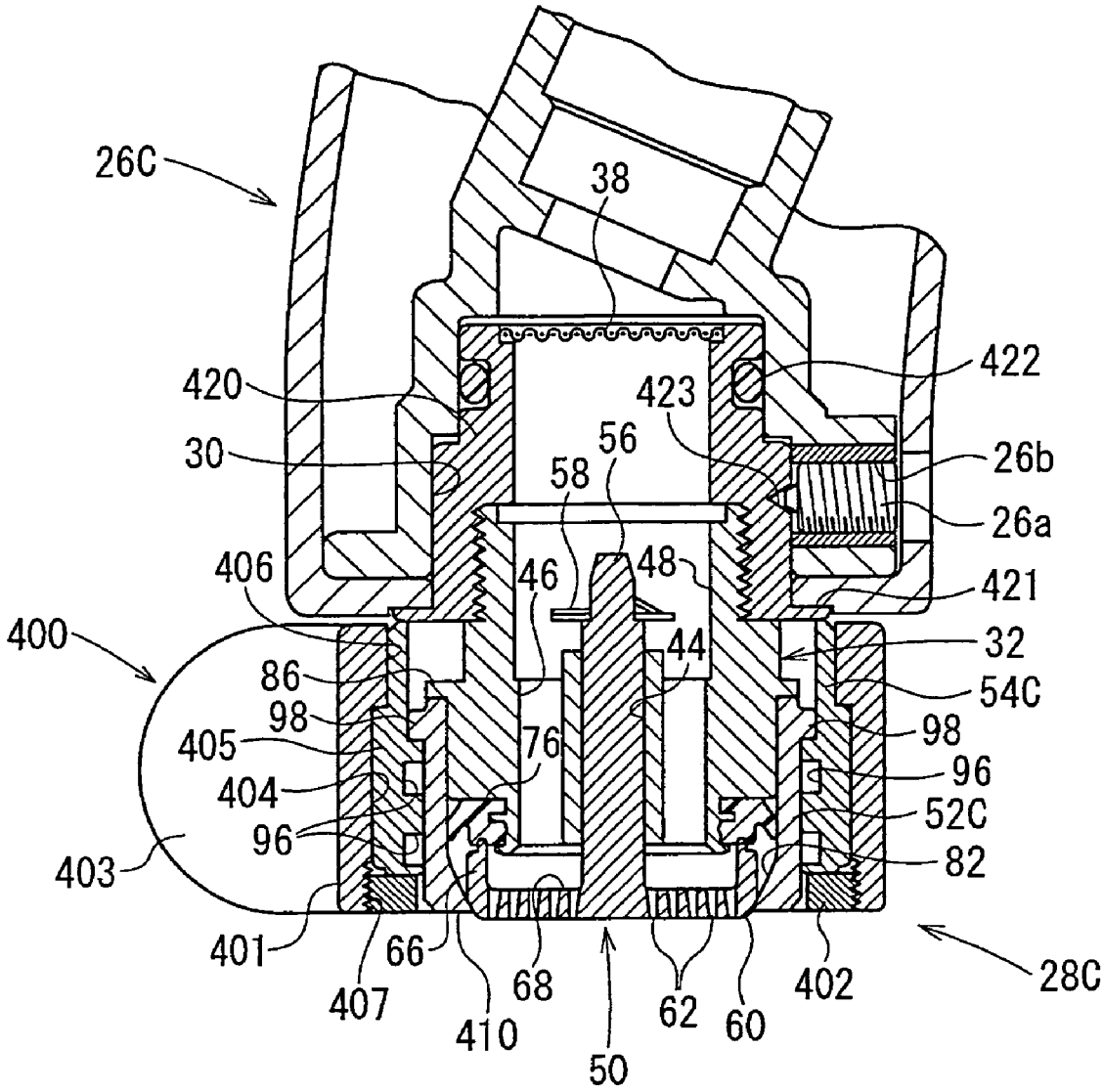
[FIG. 19]
Figure 20:
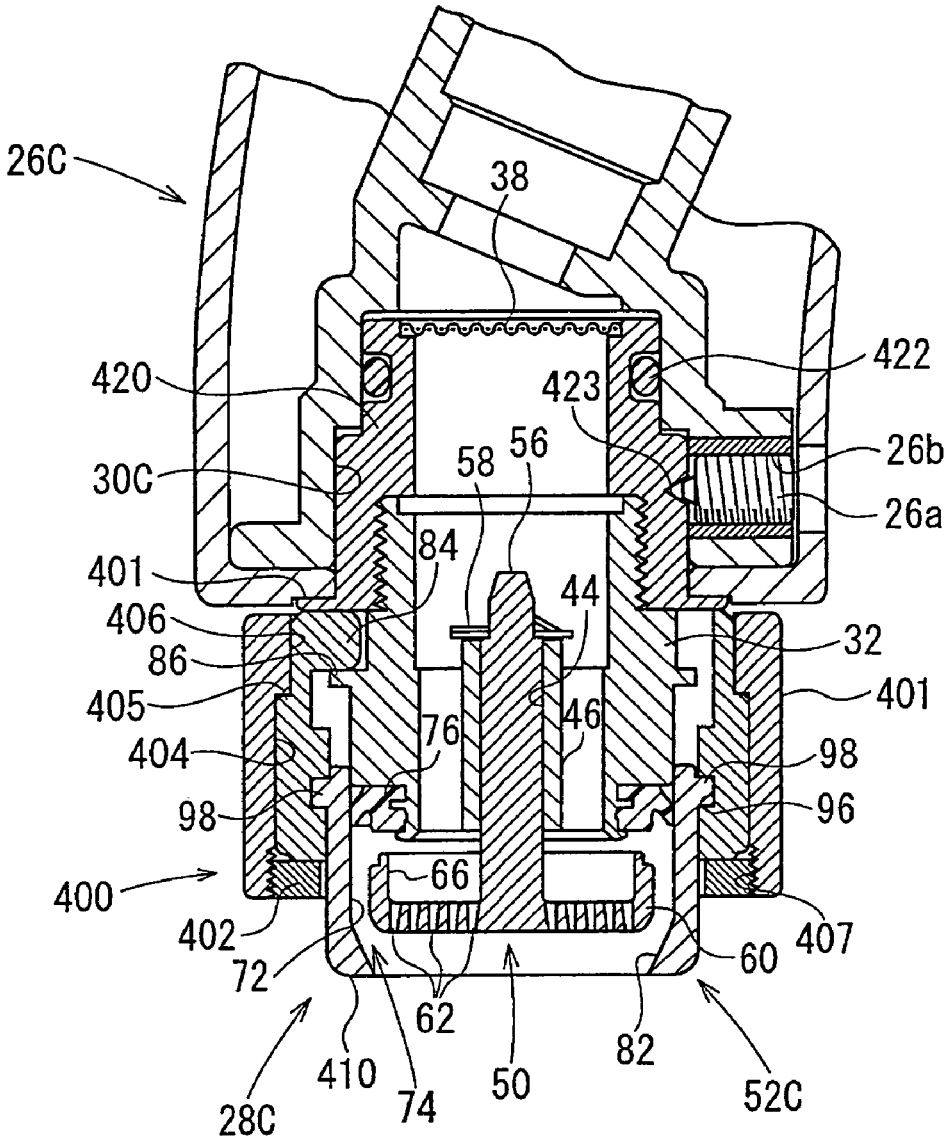
[FIG. 20]
Figure 21:
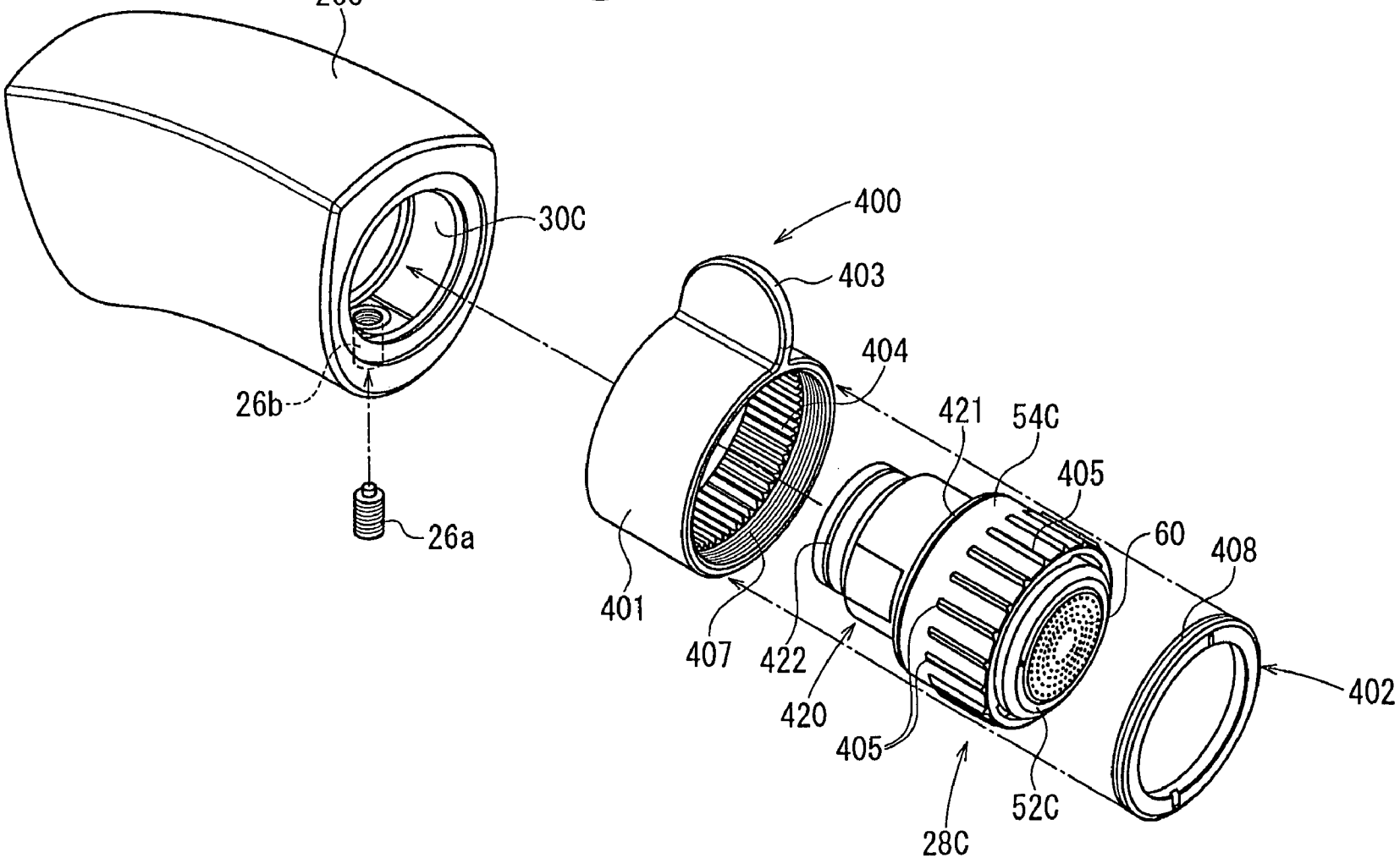
[FIG. 21]
Figure 22:
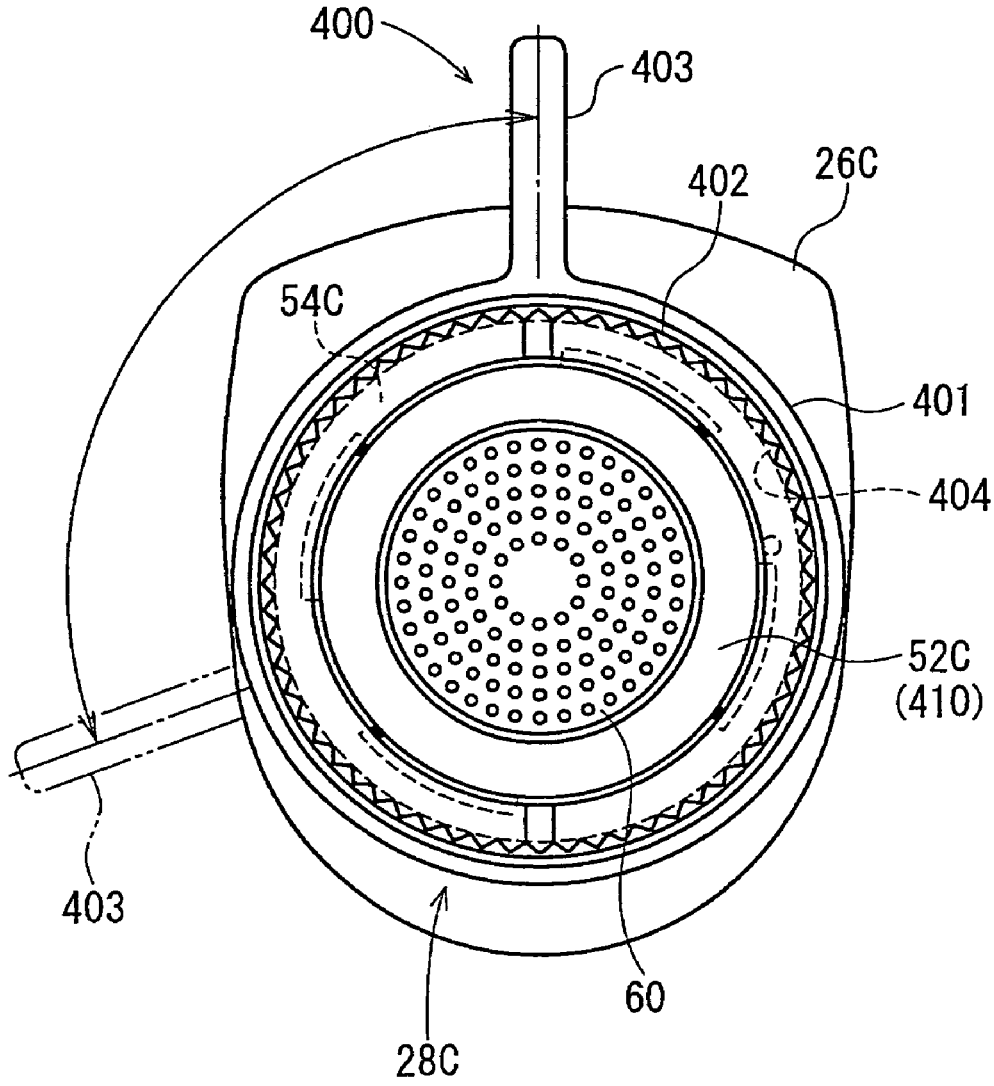
[FIG. 22]

As shown in FIG. 21, serration 404 is formed in an inner peripheral surface of the base ring 401. At an outer peripheral surface of the operating ring 54C, a convex ridge 405 to be engaged with the serration 404 is provided in a plural number of ridges at intervals in a peripheral direction. At an upper end side of the serration 404, as shown in FIGS. 19 and 20, a convex step portion 406 overhanging toward inside of the base ring 401 is formed. A female screw 407 is formed on an inner peripheral surface of the lower end side of the base ring 401.

On an outer peripheral surface of the fixing ring 402, a male screw 408 (in FIG. 21) that is screwed into the female screw 407 is formed. As shown in FIGS. 19 and 20, a diameter of a hole of an inside of the fixing ring 402 is configured to be slightly greater than an outer diameter of the tube member 52C of inside of the operating ring 54C.

In this embodiment, as shown in the drawings, although the lever main body 403 is that of an approximately half-round flat plate shape, the shape of the lever main body is not limited to that. The lever main body may be, for example, a rod-like shape, or a ring-like shape.

When the lever 400 is attached to the operating ring 54C, first, the base ring 401 is fit upon the operating ring 54C from above, while engaging the convex ridge 405 with the serration 404. Thereafter, the fixing ring 402 is screwed into the female screw 407. At this moment, the convex step portion 406 comes in contact with the upper end face of the convex ridge 405 from above, and the fixing ring 402 is overlapped with a lower end face of the operating ring 54C from below. As a result, the base ring 401 is fixed to the operating ring 54C, and the lever 400 is integrally formed with the operating ring 54C.

In this water spouting device 28C, as shown in FIG. 19, in a case when the tube member 52C is at a raised position where the straight water spouting outlet 74 is closed, the inverted tapered portion 82 of an inside of the lower end portion thereof is in contact with a middle portion in an up-and-down direction of the outer peripheral portion of the water sprinkling plate 60, the lower end face 410 is configured to be positioned upper than the lower face of the water sprinkling plate 60. Namely, when the shower spouting is performed, the tube member 52C retreats from a side periphery of the water sprinkling plate 60, and the lower portion of the water sprinkling plate 60 protrudes downward from the lower end face 410 of the tube member 52C.

In this embodiment, the water spouting device 28C is connected to an opening portion (water spouting outlet) 30C of a handheld (grip-type) water spouting head 26C via a tube-like joint 420.

A female screw is formed on an inner peripheral surface of a lower portion of the tube-like joint 420. A male screw on an outer peripheral surface of an upper portion of the joint main body 32 is screwed into this female screw. From an outer peripheral surface of the lower portion of the tube-like joint 420, an outward looking flange portion 421 is radially protruded. In this embodiment, an inward looking flange portion 84 at an upper end side of the operating ring 54C is rotatably held between the flange portion 421 and the outward looking flange portion 86 of the middle portion of the joint main body 32.

At the outer peripheral surface of the upper portion of the tube-like joint 420, an O-ring 422 is mounted. In addition, at an inner peripheral edge of the upper portion of the tube-like joint 420, a step portion is formed, and the mesh 38 is disposed in a manner so as to be hooked by the step portion.

At an outer peripheral surface of the middle portion of the tube-like joint 420, a dent 423 where a locking screw 26*a* for fixing the tube-like joint 420 to the water spouting head 26C is engaged is formed.

At a side face of the water spouting head 26C, a female screw hole 26*b* where the locking screw 26*a* is screwed is formed. The female screw hole 26*b* is allowed to communicate with an inside of the opening portion 30C while penetrating the side face of the water spouting head 26C.

When the water spouting device 28C is connected to the water spouting head 26C, first, a male screw at an upper part of the joint main body 32 is screwed into a female screw at a lower part of the tube-like joint 420, and the water spouting device 28C and the tube-like joint 420 are connected. Next, the tube-like joint 420 is fit into the opening portion 30C, and the locking screw 26*a* is screwed into the female screw hole 26*b*. A tip end of the locking screw 26*a* is overhanging into the opening portion 30C via the female screw hole 26*b*, and by means of engaging the tip end of the locking screw 26*a* with the dent 423, the tube-like joint 420 is fixed to an inside of the opening portion 30C. As a result, the water spouting device 28C and the water spouting head 26 are connected.

In the water spouting device 28C, since the lever 400 is provided on the operating ring 54C, by pressing or pulling the lever 400 frontward or backward while putting a finger or a hand on the lever 400, the operating ring 54C can be easily rotated by relatively small power.

Further, in the water spouting device 28C, when the shower spouting is performed, the tube member 52C retreats from the side periphery of the water sprinkling plate 60, and the lower portion of the water sprinkling plate 60 is protruded downward from the lower end face 410 of the tube member 50C. Consequently, the water spouted from the water sprinkling hole 62 of the lower face of the water sprinkling plate 60 is prevented from being scattered around the circumference by means of hitting the tube member 52C or the like.

Thus, the embodiment of the present invention is described in detail. However, the description is illustrative of the invention and the various modifications can be made in the structure without departing from the spirit of the present invention.

The invention claimed is:

1. A water spouting device to be provided in a water faucet facility comprising:

a water sprinkling plate having a plurality of water sprinkling holes defined therein for a shower spouting;

a tube member comprising a water spouting outlet for a straight water spouting, the water spouting outlet having a circular ring shape, and an inverted tapered portion having a surrounding convex portion at an inner peripheral surface at a lower portion of the tube member, wherein the water spouting outlet surrounds a periphery of the plurality of water sprinkling holes and an outer periphery of the water sprinkling plate;

a flow path switching mechanism for performing a first flow path selection for supplying water only to the plurality of water sprinkling holes through the water sprinkling plate so as to perform the shower spouting and a second flow path selection for supplying the water to both the plurality of water sprinkling holes and the water spouting outlet so as to perform the straight water spouting; and a joint member where the water flows in from an upper end side and flows out from a lower end side, and a sealing member provided at the lower end side, and wherein the tube member fits upon the joint member and the sealing member, wherein the water sprinkling plate is provided in an inner part of the tube member such that the water spouting outlet for the straight water spouting entirely surrounds the water sprinkling holes, and wherein the water sprinkling plate is movable in an up-and-down direction, and the flow path switching mechanism comprises an operating member for moving the water sprinkling plate in the up-and-down direction, and wherein when the water sprinkling plate moves upward and an outer peripheral edge of the water sprinkling plate is brought to be in contact with the sealing member, the water supplied to the water spouting outlet is interrupted and the water only flows to the water sprinkling plate through the water sprinkling holes, and when the water sprinkling plate moves down and the outer peripheral edge of the water sprinkling plate is spaced apart from the sealing member, the water flows through both of the water sprinkling holes in the water sprinkling plate and the water spouting outlet, and wherein the tube member is movable in an up-and-down direction, and the operating member moves the water sprinkling plate up-and-down by moving the tube member up-and-down.

2. The water spouting device according to claim 1, wherein the sealing member is in contact with the inner peripheral surface of the tube member in a manner so as to be water-tight and slidable.

3. The water spouting device according to claim 1, further comprising a stopping ring or stopping member for preventing the water sprinkling plate from moving downward further when the water sprinkling plate moves downward at a predetermined stroke after being spaced apart from the sealing member, wherein the tube member is movable in the up-and-down direction at a stroke longer than that of the water sprinkling plate, and wherein an outer peripheral edge portion of the water sprinkling plate is in contact with the surrounding convex portion from above until the water sprinkling plate moves downward at a predetermined stroke, and the tube member moves downward further after the water sprinkling plate moves downward at the predetermined stroke, and thereby the surrounding convex portion is spaced apart from the outer peripheral edge portion of the water sprinkling plate, and the water spouting outlet is formed between the surrounding convex portion and the water sprinkling plate.

4. The water spouting device according to claim 3, wherein the surrounding convex portion is formed of the inverted tapered portion wherein as the position in the inverted tapered portion becomes lower, the diameter thereof becomes smaller.

5. The water spouting device according to claim 3, wherein the joint member comprises a fitting opening penetrating in the up-and-down direction, and the water sprinkling plate comprises a shaft portion extending in the up-and-down direction, wherein the shaft portion is slidably inserted into the fitting opening and an upper portion of the shaft portion protrudes upward from an upper end of the fitting opening, and wherein the stopping member is mounted on the upper portion of the shaft portion, and the water sprinkling plate is prevented from moving downward by means of contacting of the stopping member with an upper end face of the fitting opening.

6. The water spouting device according to claim 5, wherein a plurality of penetrating openings penetrating in the up-and-down direction is formed around the fitting opening, and the water flows downward passing through the plurality of penetrating openings.

* * * * *